US012808108B2

(12) United States Patent
Lee et al.

(10) Patent No.: US 12,808,108 B2
(45) Date of Patent: Nov. 24, 2026

(54) INTERFACE AND LAUNDRY TREATING APPARATUS HAVING THE SAME

(71) Applicant: LG Electronics Inc., Seoul (KR)

(72) Inventors: Hyunseung Lee, Seoul (KR); Kyuchul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 495 days.

(21) Appl. No.: 18/575,202

(22) PCT Filed: Jun. 28, 2022

(86) PCT No.: PCT/KR2022/009201
§ 371 (c)(1),
(2) Date: Dec. 28, 2023

(87) PCT Pub. No.: WO2023/277511
PCT Pub. Date: Jan. 5, 2023

(65) Prior Publication Data

US 2024/0344262 A1 Oct. 17, 2024

(30) Foreign Application Priority Data

Jun. 28, 2021 (KR) ..... 10-2021-0084005

(51) Int. Cl.
*D06F 34/32* (2020.01)
*D06F 23/02* (2006.01)
(Continued)

(52) U.S. Cl.
CPC ..... *D06F 34/32* (2020.02); *D06F 23/02* (2013.01); *D06F 34/08* (2020.02); *D06F 34/30* (2020.02);
(Continued)

(58) Field of Classification Search
CPC ..... D06F 34/32; D06F 34/30; D06F 34/34; D06F 34/08; D06F 23/02; D06F 37/42;
(Continued)

(56) References Cited

U.S. PATENT DOCUMENTS 7,146,749 B2 * 12/2006 Barron ..... D06F 58/203 34/601
7,322,126 B2 * 1/2008 Beaulac ..... D06F 58/38 34/554
(Continued)

FOREIGN PATENT DOCUMENTS

CN 106544824 3/2017
CN 111434832 7/2020
(Continued)

OTHER PUBLICATIONS

International Search Report and Written Opinion in Appln. No. PCT/KR2022/009201, mailed on Oct. 24, 2022, 12 pages.
(Continued)

*Primary Examiner* — Stephen M Gravini
(74) *Attorney, Agent, or Firm* — Fish & Richardson P.C.

(57) ABSTRACT

The present disclosure relates to a laundry treating apparatus including a window that blocks a display from being exposed to the outside and a sealant disposed between an inner circumferential face of the housing and an outer circumferential face of the window to fix the window to the housing or to block inflow of foreign substances into the housing.

22 Claims, 16 Drawing Sheets

(51) Int. Cl.

| | |
|---|---|
| ***D06F 34/08*** | (2020.01) |
| ***D06F 34/30*** | (2020.01) |
| ***D06F 34/34*** | (2020.01) |
| ***D06F 37/42*** | (2006.01) |
| ***D06F 39/12*** | (2006.01) |
| ***D06F 58/02*** | (2006.01) |
| ***D06F 58/20*** | (2006.01) |
| ***D06F 105/58*** | (2020.01) |

(52) U.S. Cl.
CPC ..... *D06F 34/34* (2020.02); *D06F 37/42* (2013.01); *D06F 39/12* (2013.01); *D06F 58/02* (2013.01); *D06F 58/20* (2013.01); *D06F 2105/58* (2020.02)

(58) Field of Classification Search
CPC ..... D06F 39/12; D06F 58/02; D06F 58/20; D06F 2105/58
USPC ..... 34/88, 595–610
See application file for complete search history.

(56) References Cited

U.S. PATENT DOCUMENTS

| | | | | |
|---|---|---|---|---|
| 8,336,227 | B2 * | 12/2012 | Bae | D06F 58/203 68/17 R |
| 10,550,506 | B2 | 2/2020 | Oh et al. | |
| 11,028,527 | B2 * | 6/2021 | Vaive | D06F 58/26 |
| 11,299,835 | B2 * | 4/2022 | Chae | D06F 37/28 |
| 11,486,081 | B2 * | 11/2022 | Pattarello | D06F 58/34 |
| 12,098,496 | B2 * | 9/2024 | McGrane | D06F 34/18 |
| 12,338,570 | B2 * | 6/2025 | Yeom | D06F 58/20 |
| 12,534,843 | B2 * | 1/2026 | Fuchs | D06F 34/05 |
| 12,618,190 | B2 * | 5/2026 | Seo | D06F 25/00 |
| 12,630,969 | B2 * | 5/2026 | Kim | D06F 58/38 |
| 2019/0301744 | A1 | 10/2019 | Yang | |
| 2021/0005403 | A1 | 1/2021 | Huang et al. | |
| 2024/0168501 | A1 * | 5/2024 | Zheng | A61L 9/22 |
| 2024/0344262 | A1 * | 10/2024 | Lee | D06F 39/12 |

FOREIGN PATENT DOCUMENTS

| | | | | | |
|---|---|---|---|---|---|
| EP | 3168357 | A1 | | 5/2017 | |
| JP | 2013-188273 | | | 9/2013 | |
| JP | 2021-029724 | | | 3/2021 | |
| KR | 10-2019-950027598 | U | | 10/1995 | |
| KR | 20230001286 | A | * | 1/2023 | D06F 34/05 |
| WO | 2021/000300 | A1 | | 1/2021 | |
| WO | WO-2022164039 | A1 | * | 8/2022 | B01D 46/00 |
| WO | WO-2023277511 | A1 | * | 1/2023 | D06F 58/20 |

OTHER PUBLICATIONS

Notice of Allowance in Korean Appln. No. 10-2021-0084005, mailed on Oct. 22, 2024, 2 pages (with English translation).
Extended European Search Report in European Appln. No. 22833567.5, mailed on Mar. 25, 2025, 9 pages.
Office Action in Australian Appln. No. 2022304447, mailed on May 14, 2025, 5 pages.

* cited by examiner

[Fig. 1]
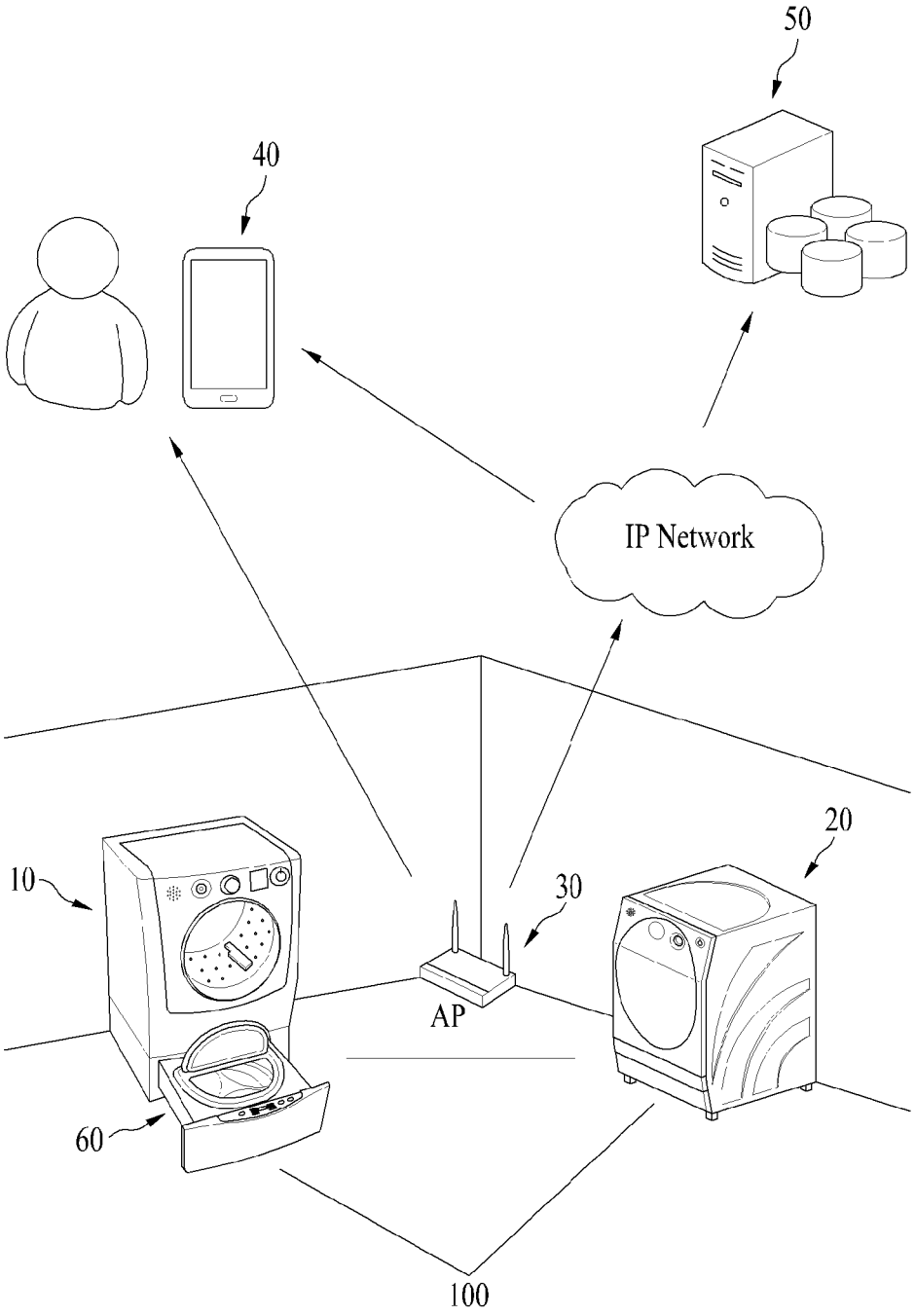

[Fig. 2]
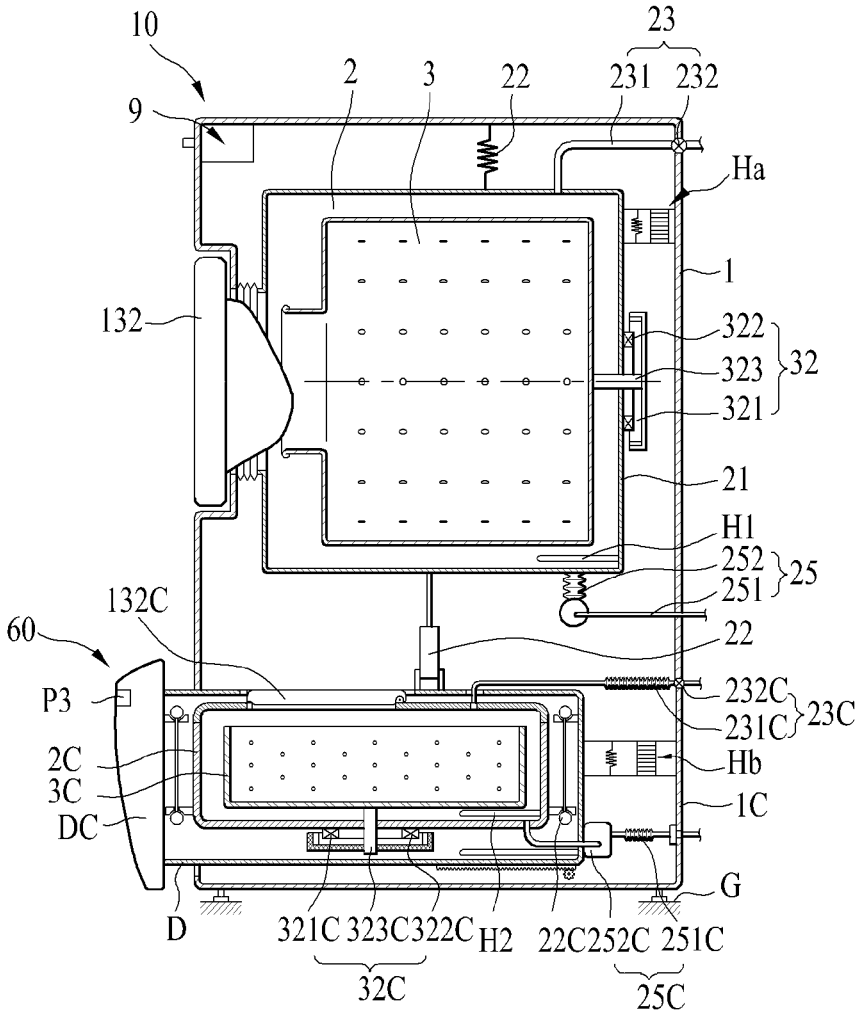

[Fig. 3]
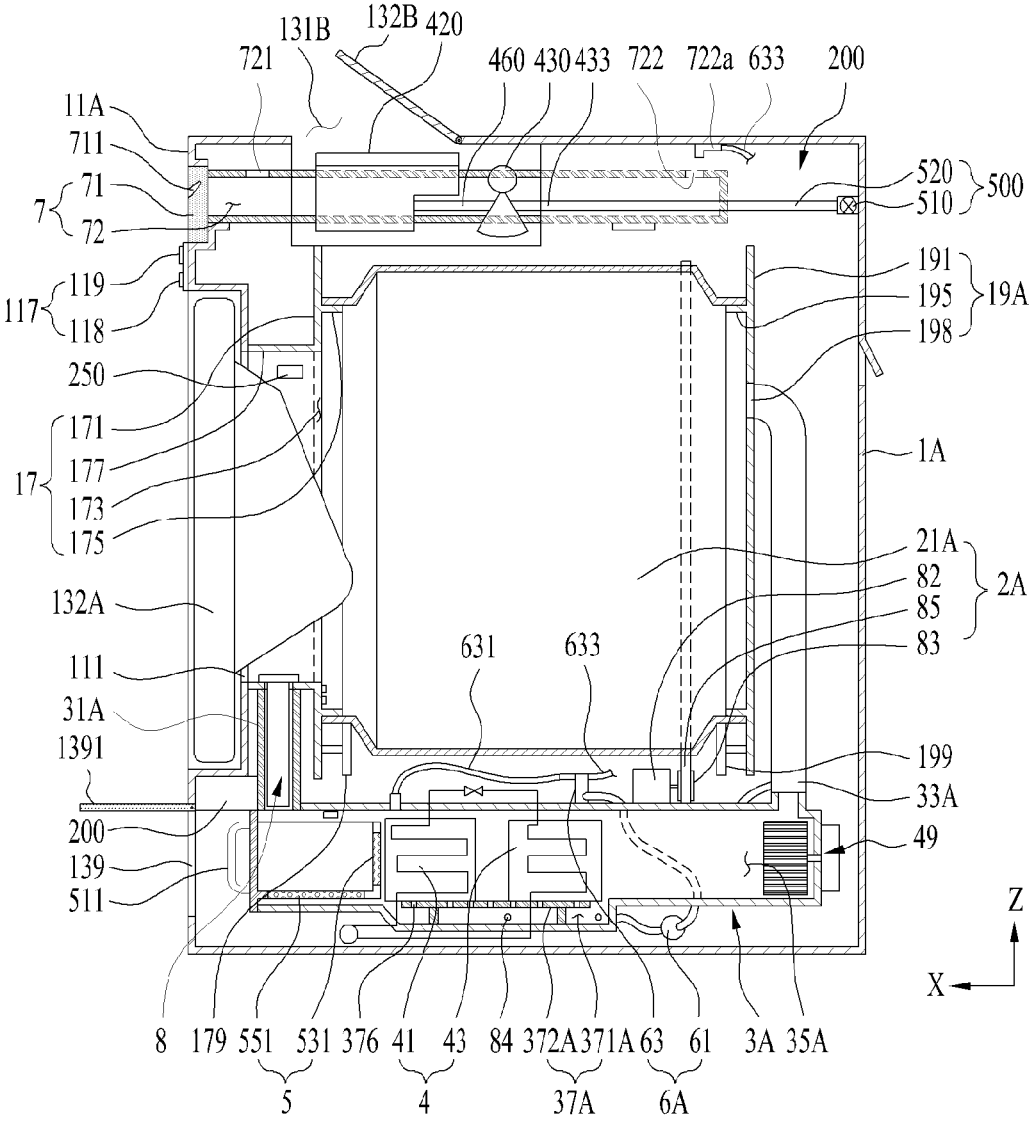

[Fig. 4]
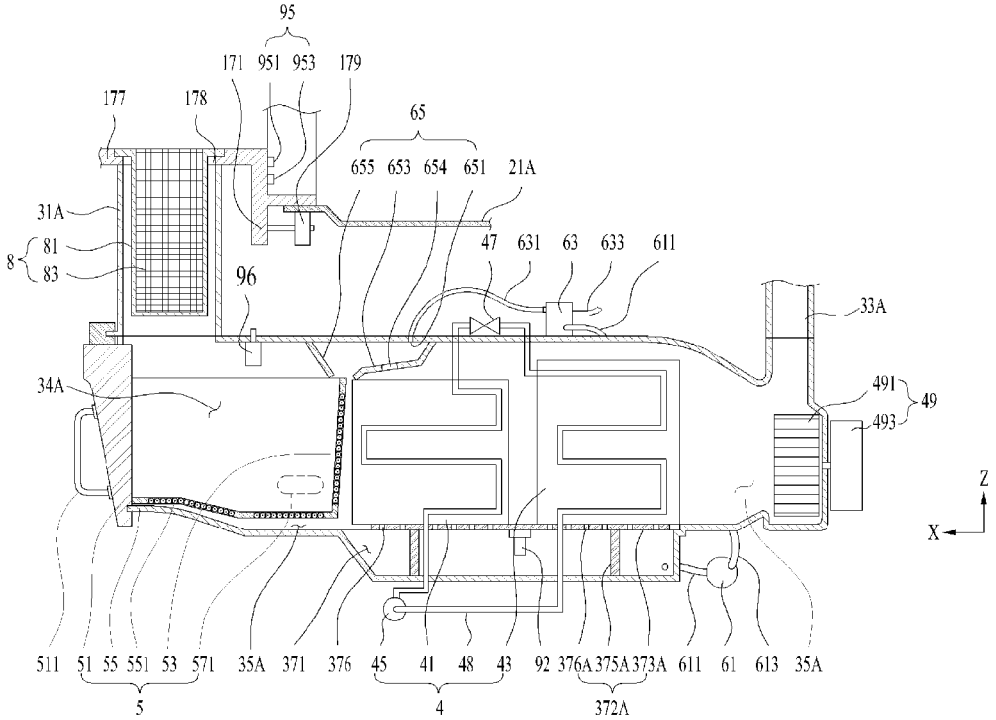

[Fig. 5]
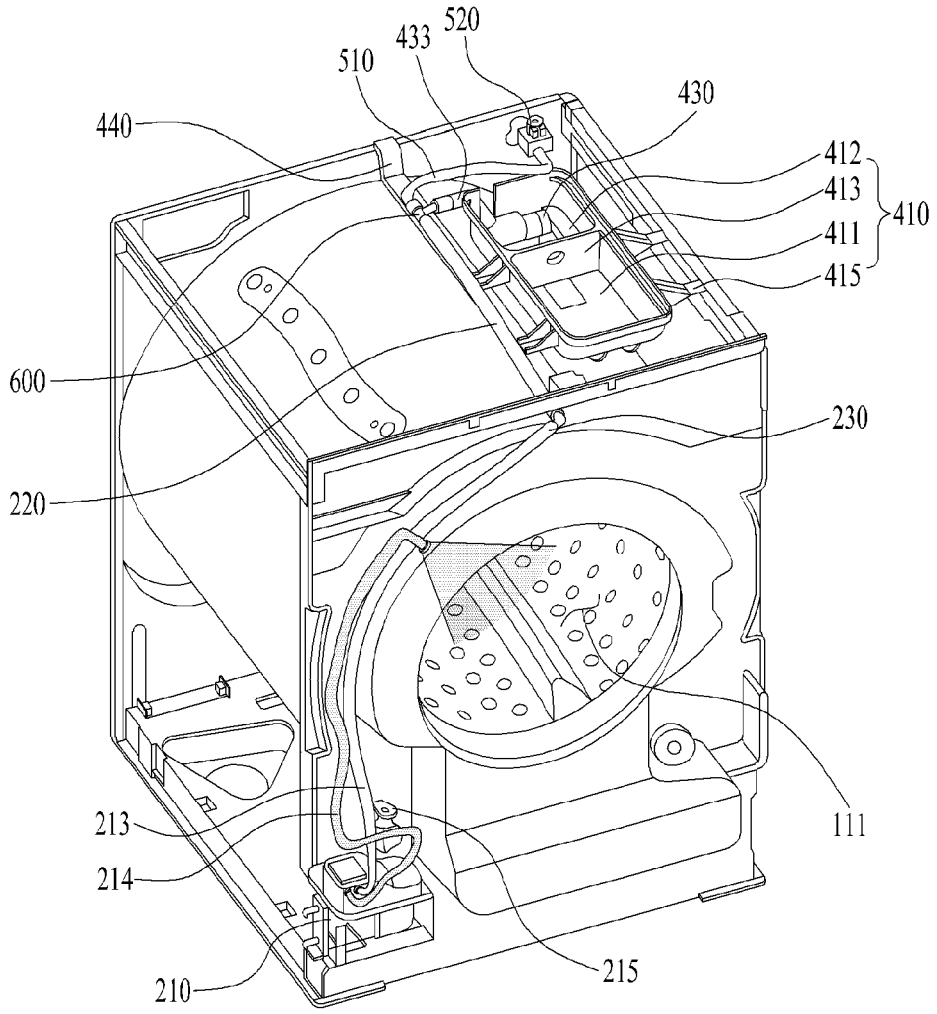

[Fig. 6]
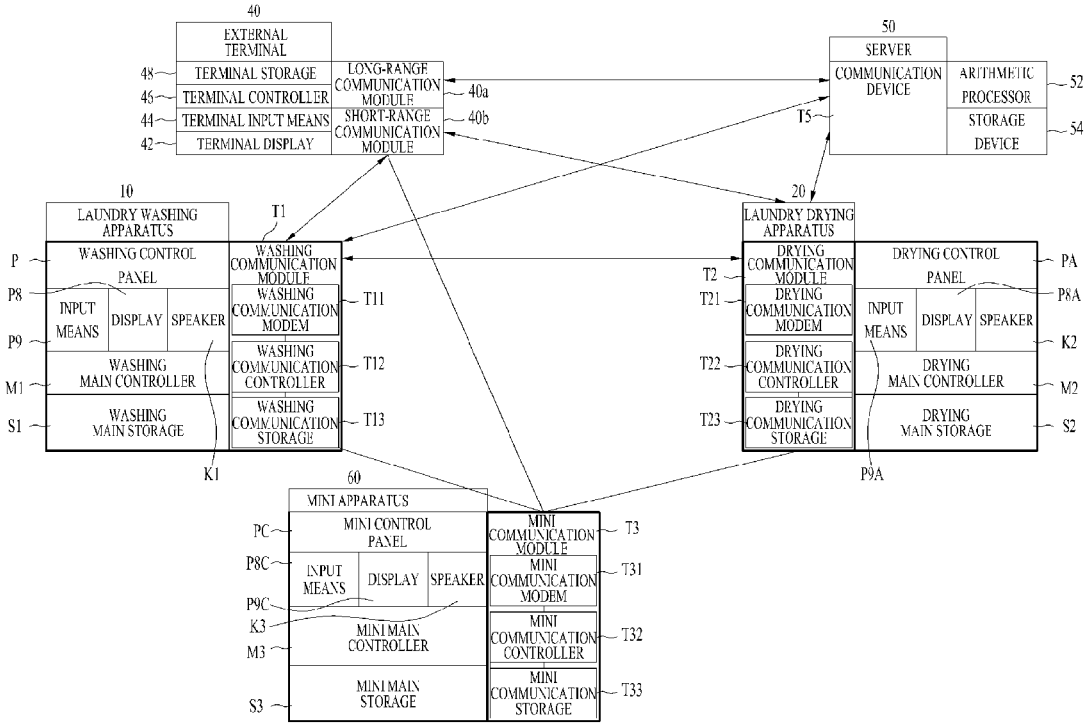

[Fig. 7]
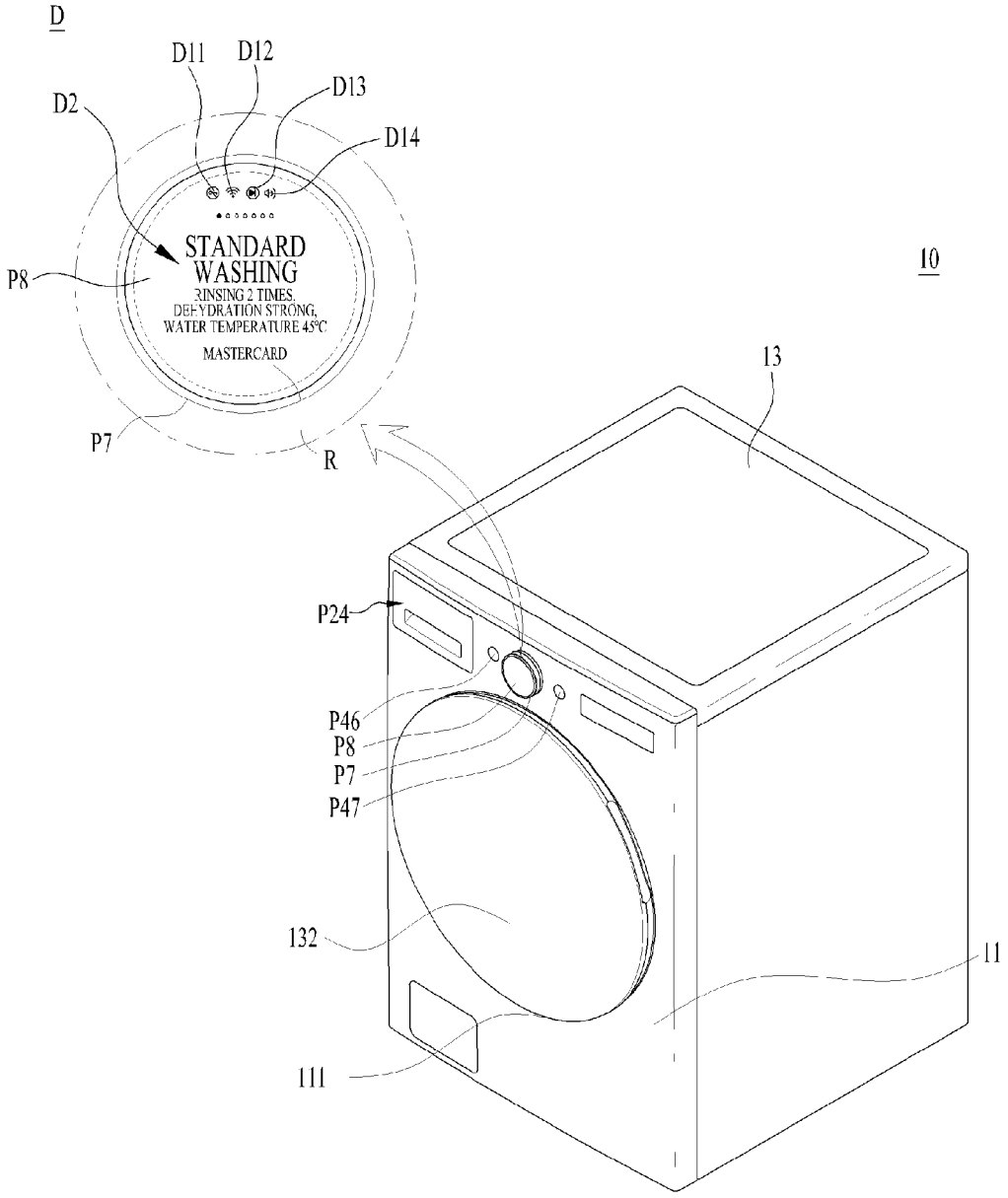

[Fig. 8]
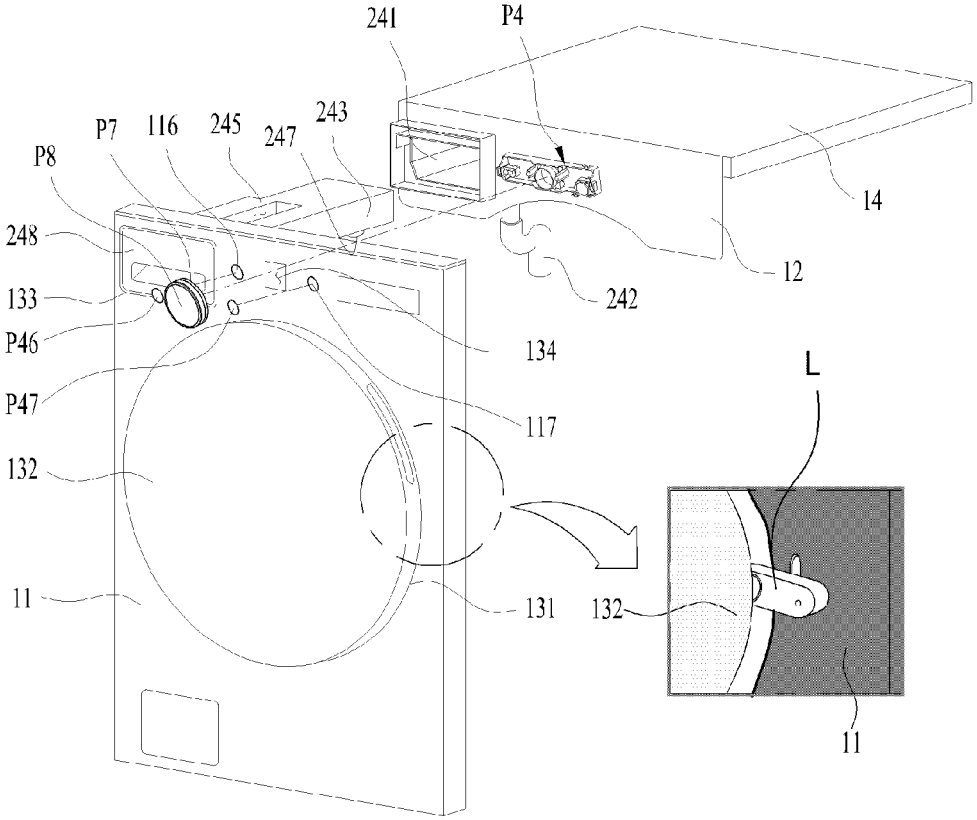

[Fig. 9]
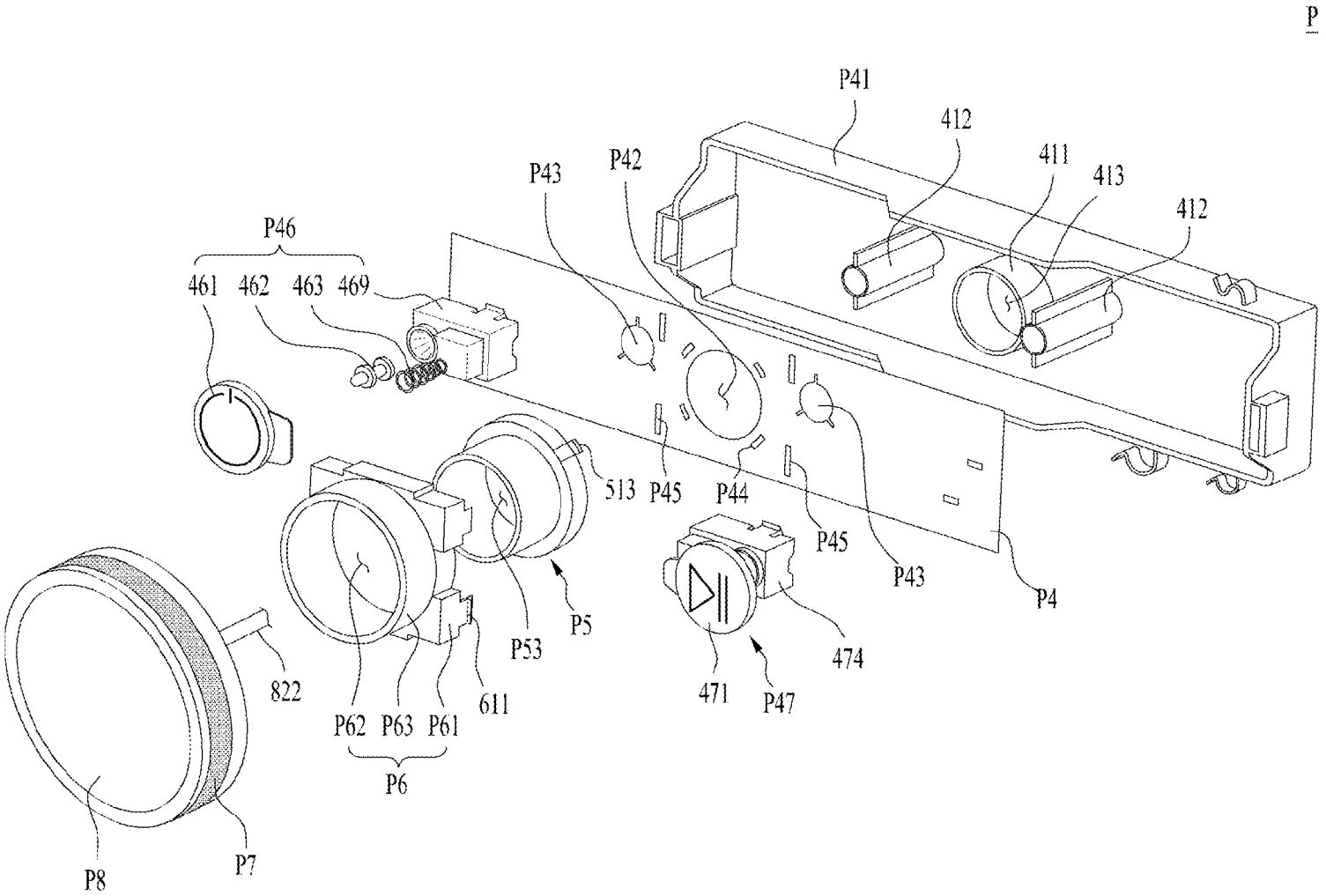

[Fig. 10]
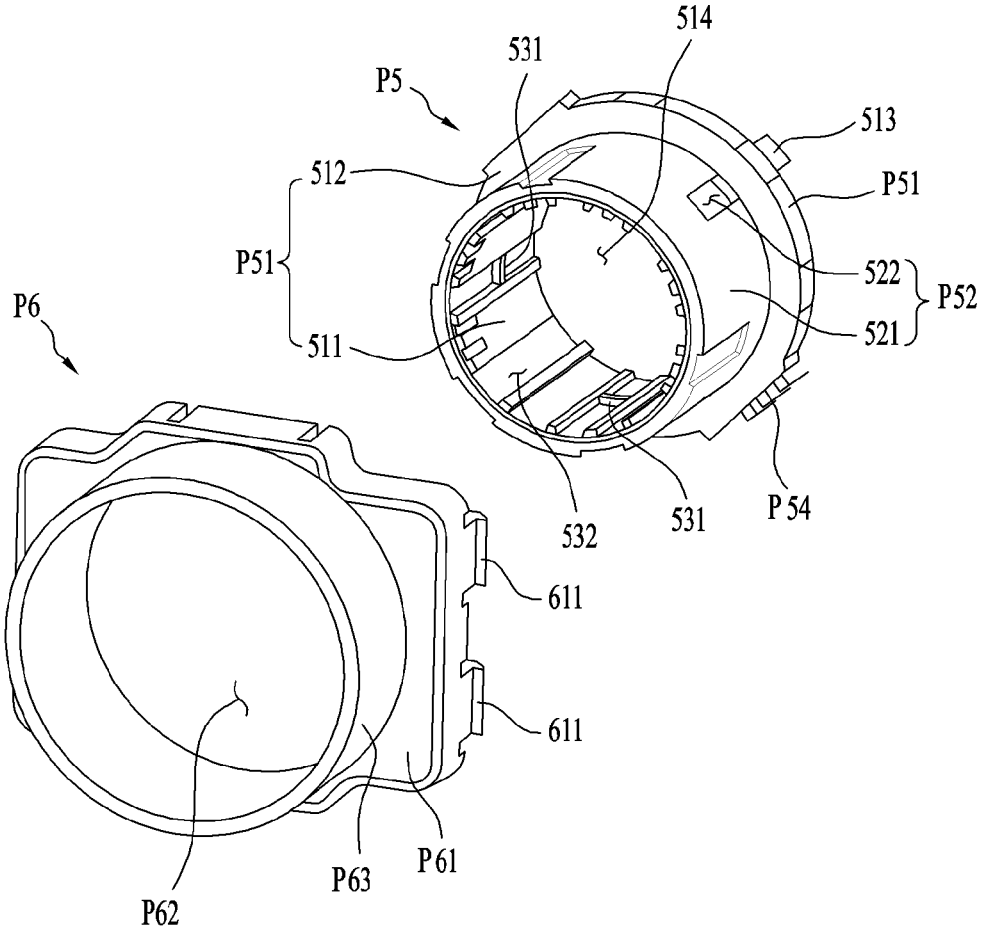

[Fig. 11]
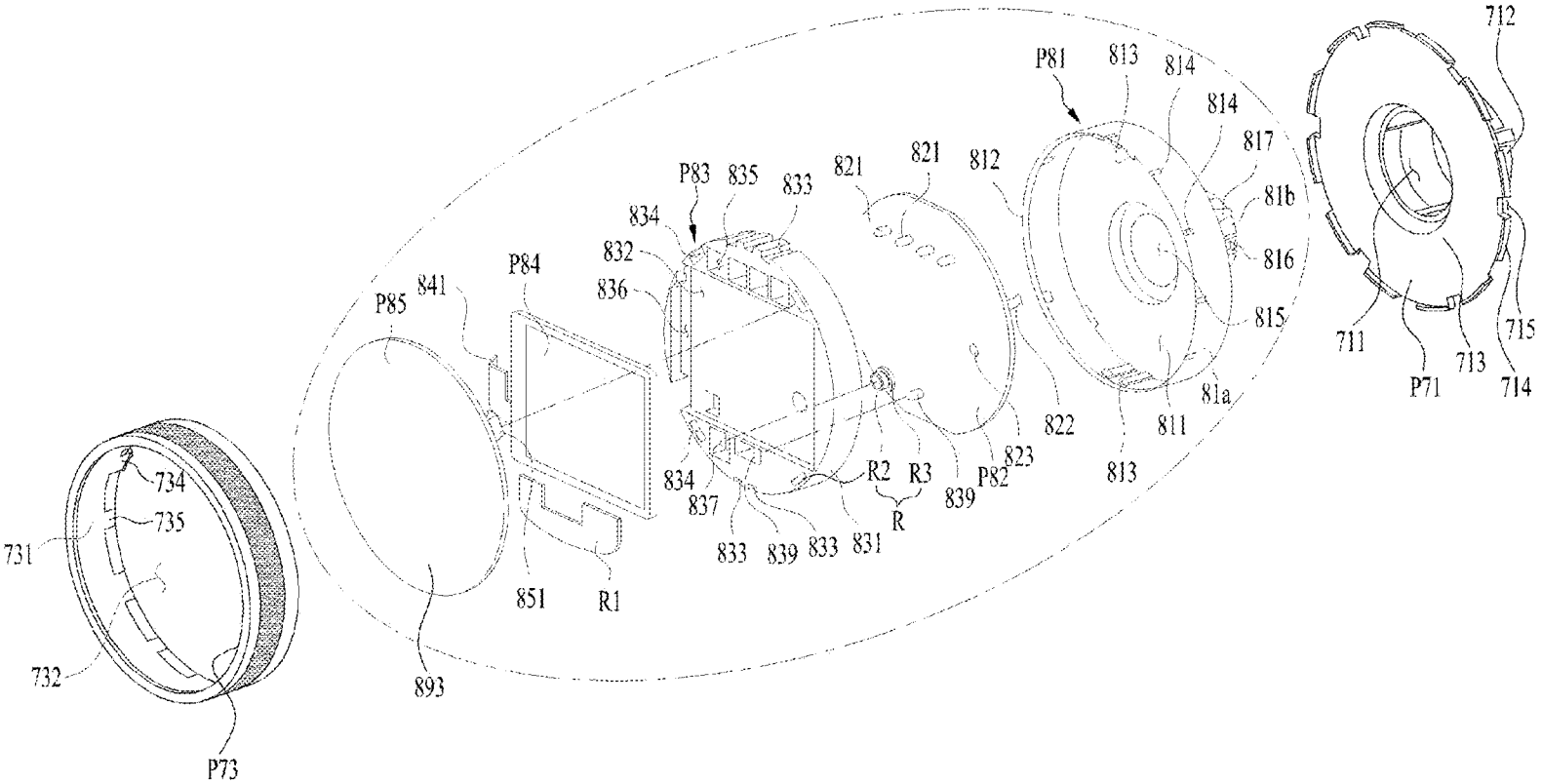

[Fig. 12]
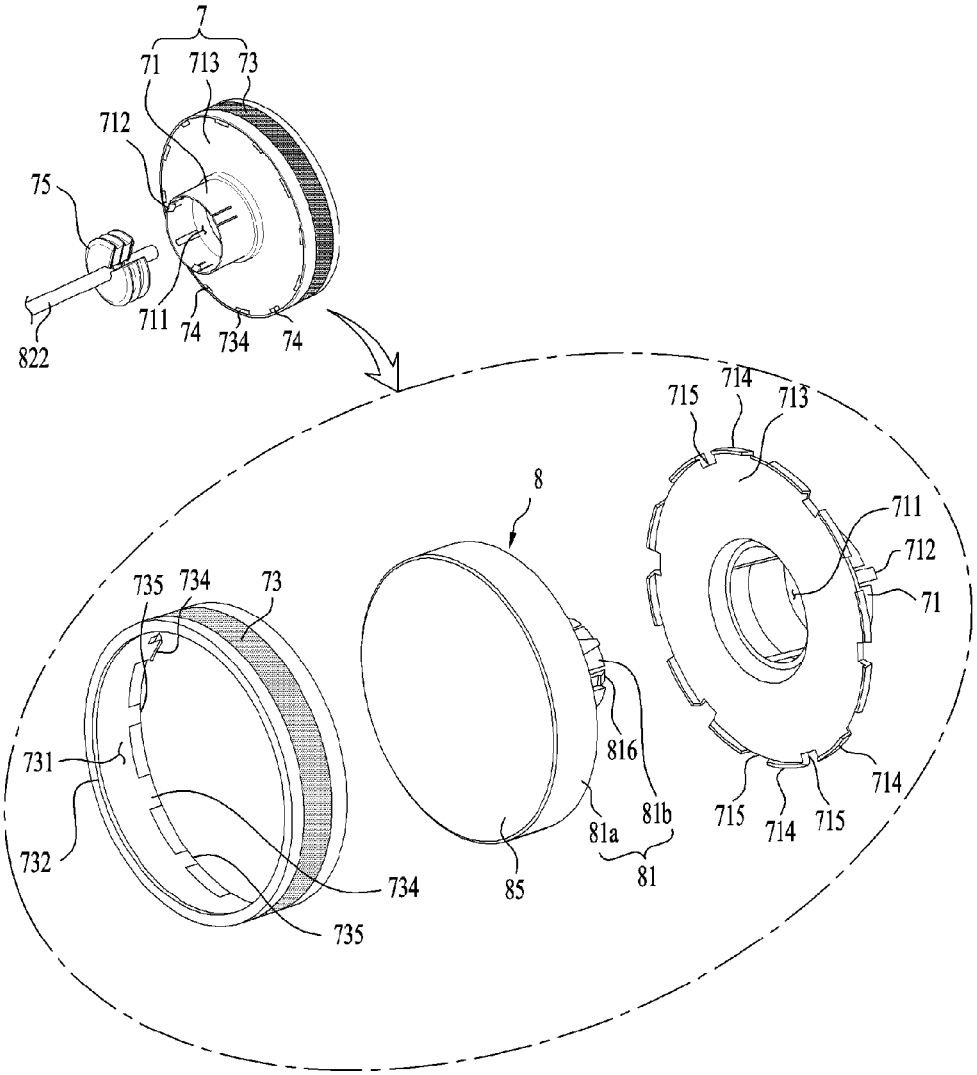

[Fig. 13]
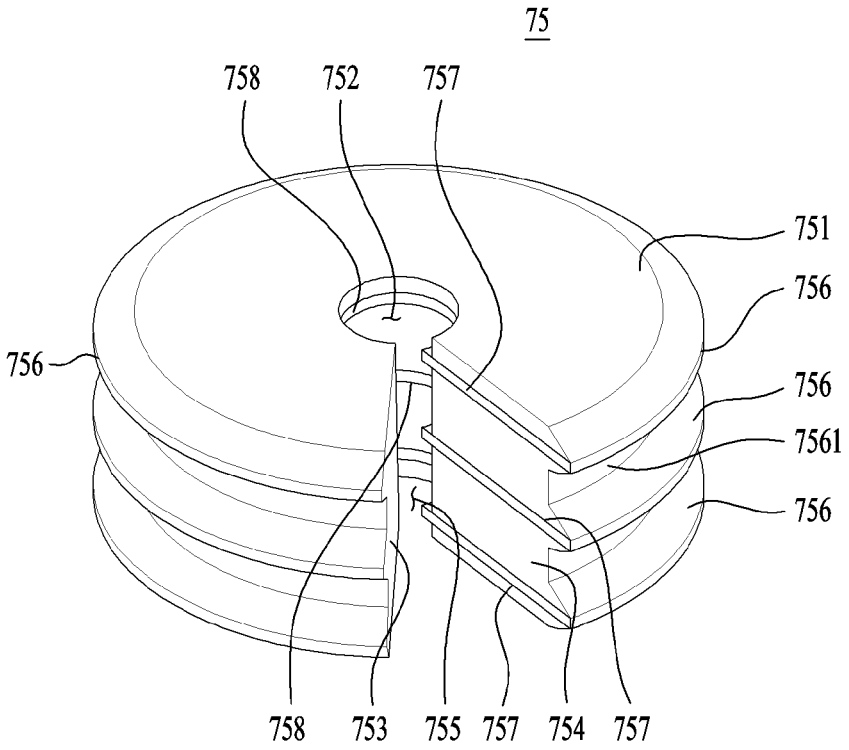
[Fig. 14]
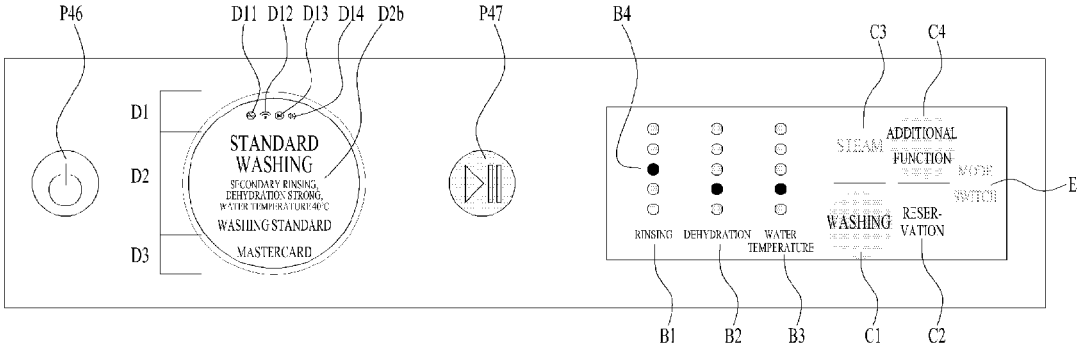

[Fig. 15]
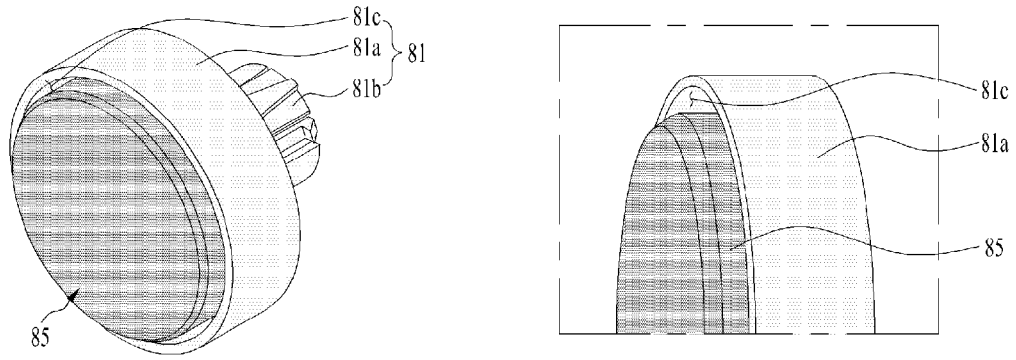
(a) (b)
[Fig. 16]
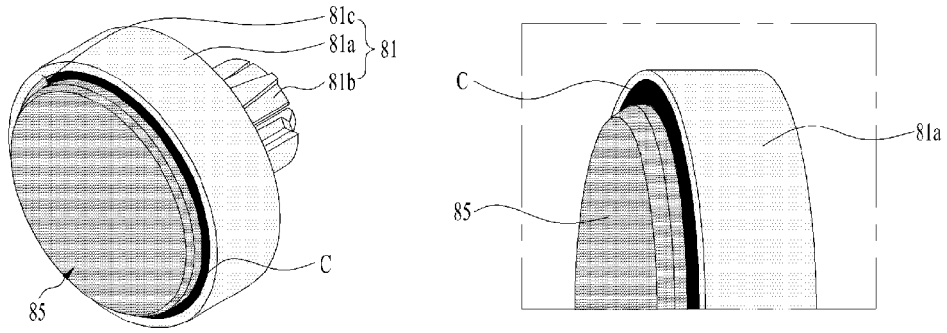
(a) (b)

[Fig. 17]
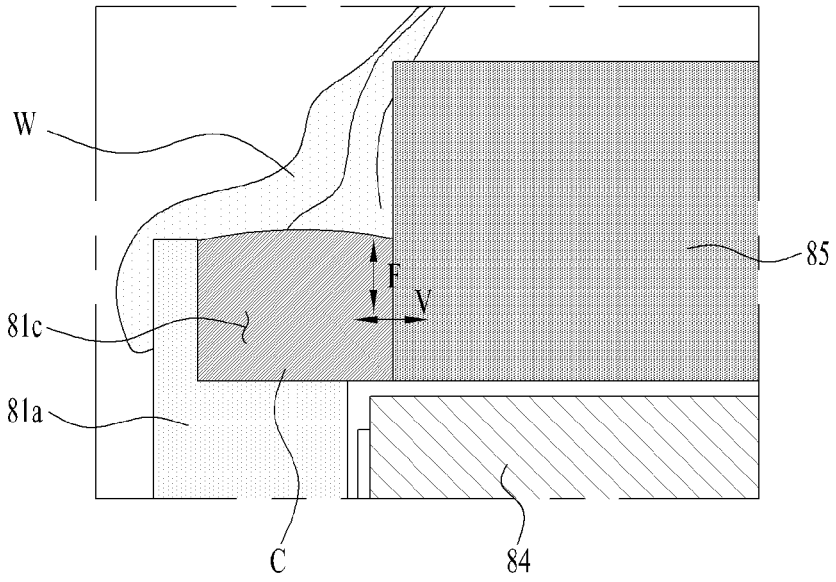
[Fig. 18]
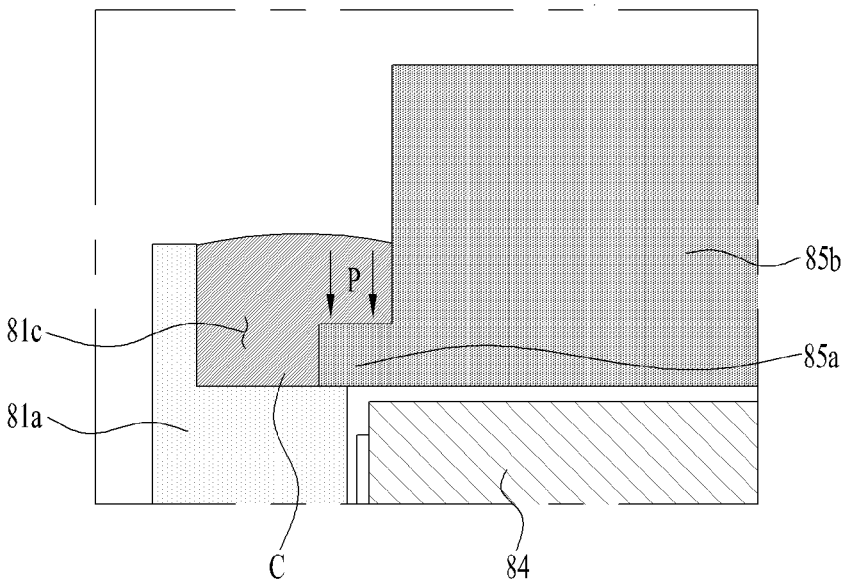

[Fig. 19]
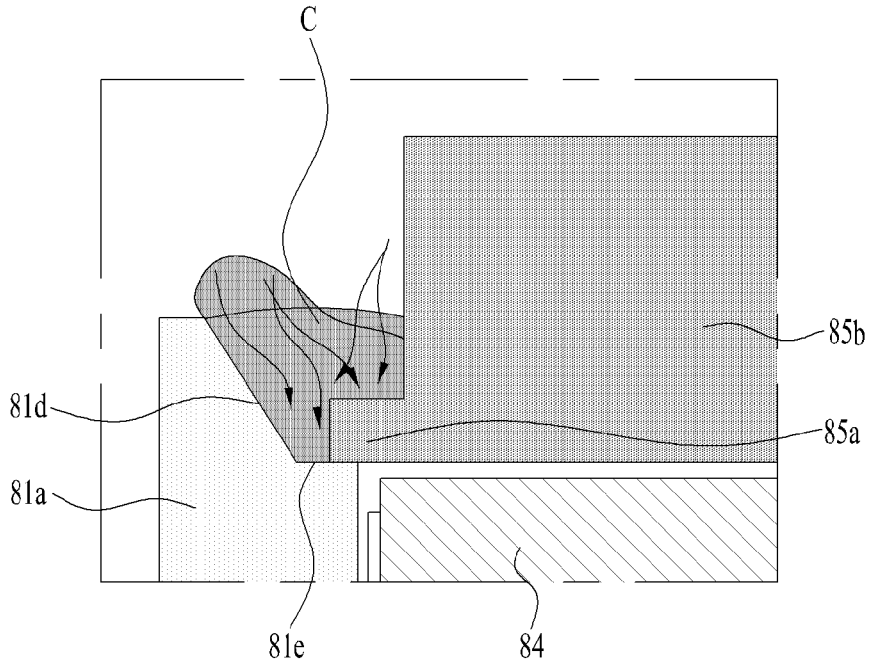

INTERFACE AND LAUNDRY TREATING APPARATUS HAVING THE SAME

CROSS-REFERENCE TO RELATED APPLICATIONS

This application is a National Stage application under 35 U.S.C. § 371 of International Application No. PCT/KR2022/009201, filed on Jun. 28, 2022, which claims the benefit of Korean Application Nos. 10-2021-0084005, filed on Jun. 28, 2021. The disclosures of the prior applications are incorporated by reference in their entirety.

TECHNICAL FIELD

This application relates to an interface and a laundry treating apparatus having an interface.

BACKGROUND

An input/output device (an interface) for a user to input a control command to an electronic device is essential in the electronic device including a laundry treating apparatus capable of washing, drying, and washing and drying laundry (a common name of an object to be washed or an object to be dried).

The conventional interfaces were designed such that a display portion that displays a control command that a user may select, a search interface that allows the user to search for the control command displayed on the display portion, a selection interface that allows the user to select the control command displayed on the display portion, and input means that requests execution of the control command selected by the user are located in spaces separated from each other (Public No. 10-2014-0023986).

That is, in the conventional interface, a display (an LCD, an LED panel, and the like) on which the control command is displayed, a knob or a button that may search for the control command by allowing a control command executable by the corresponding electronic device to be displayed on the display, a button that inputs a control command to select the control command displayed on the display, a button that inputs a control command to request execution of the selected control command, and the like are located in spaces separated from each other. Such an arrangement was a factor determining a design of the interface (a design of the control panel) located on a front face of the electronic device such as the laundry treating apparatus.

In the conventional interface of the above structure, because the devices including the display had to be dispersedly arranged along a width direction of the electronic device or distributed along a height direction of the electronic device, a great space was required for installation of the interface.

In one example, in a case of a laundry treating apparatus having a conventional knob or the like, a course and an option were selected by rotating the knob. When the knob is rotated, courses and options corresponding to the knob were able to be sequentially selected. The user may operate the laundry treating apparatus by pressing an execution button only when the knob is placed on desired course and option.

Therefore, in the conventional laundry treating apparatus having the control panel such as the conventional knob, when the course and the option desired by the user are on the back burner, the user had to always rotate the knob repeatedly to select the course and option.

In addition, the conventional laundry treating apparatus is inconvenient to repeatedly input an input to the control panel to set a specific option when the user selects the option as well as the desired course.

In the control panel having the display portion inside the rotary knob, there was a fear that water generated in the laundry or the like may be put between an outer circumferential face of the display portion and the rotary knob.

In addition, even when a separate sealing member is further disposed between the display portion and the rotary knob, there was a limitation in that the sealing member may be deviated between the display portion and the rotary knob.

In addition, there was a risk of damage to a circuit board of the display portion by water or foreign substances because there is always a gap between the display portion and the rotary knob due to an assembly tolerance of the sealing member itself.

In addition, the display portion may include a window or a cover that blocks external impact or inflow of the foreign substances. In this regard, when the window is disposed inside rotating manipulation portion, a fixed force of the window cannot be guaranteed, so that there was a fear that the window may deviate from the manipulation portion.

SUMMARY

The present disclosure is to provide a laundry treating apparatus that may ensure durability of a display portion even when the display portion having liquid crystals fixed inside rotating manipulation portion is disposed.

The present disclosure is to provide a laundry treating apparatus capable of blocking inflow of water or foreign substances between an interior of the manipulation portion and the display portion.

The present disclosure is to provide a laundry treating apparatus that prevents a cover or a window that protects the display portion from deviating from the manipulation portion to the outside.

In order to solve the above problems, the present disclosure provides a laundry treating apparatus including a sealing member for sealing manipulation portion and a display portion exposed to a front face of a cabinet from a control panel.

In this regard, the sealing member is for preventing the manipulation portion and a circuit board disposed inside the display portion from being exposed to foreign substances.

In this regard, the display portion includes a display for displaying the selected course thereon, a housing disposed inside the manipulation portion so as to accommodate the display therein, a window disposed in front of the housing so as to prevent the display from being exposed to the outside of the housing, and a sealing member for blocking inflow of foreign substances rearwardly of the window or into the housing.

In one implementation, the display portion further includes a circuit board accommodated in the housing and configured to control the display. The sealing member is disposed to seal the housing to prevent the circuit board from being exposed to the foreign substances.

In one implementation, the laundry treating apparatus further includes a casing coupled to a rear face of the cabinet so as to accommodate a control panel connected to the circuit board therein. The casing may form an appearance of the control panel.

In this regard, the housing includes an accommodating body for accommodating the circuit board and the display therein, wherein the window is disposed in front of the accommodating body, and a fixed body extending from the rear of the accommodating body so as to fix the accommodating body to the casing, wherein the fixed body accommodates therein a control line for connecting the circuit board and the control panel to each other.

In this regard, the sealing member seals at least one of a space between the accommodating body and the window and the inside of the fixed body.

In one implementation, the sealing member includes a first sealing member for sealing a space between an inner circumferential face of the housing and an outer circumferential face of the window.

In one implementation, the housing includes a mounting rib extending from the accommodating body so as to allow the window to seat thereon, wherein the mounting rib provides a space for the first sealing member to be embedded, and a diameter of an inner circumferential face of the mounting rib is larger than a diameter of an inner circumferential face of the accommodating body.

In one implementation, the window includes a cover body disposed on a front face of the display so as to shield the display, and an extended portion protruding from the cover body toward the mounting rib and accommodated in the first sealing member.

In one implementation, a thickness of the extended portion is smaller than a thickness of the mounting rib.

In one implementation, a thickness of the cover body is greater than a thickness of the mounting rib.

In one implementation, a diameter of an outer circumferential face of the mounting rib is the same as a diameter of an outer circumferential face of the accommodating body.

In one implementation, the mounting rib includes an exposed face spaced apart from the outer circumferential face of the window and exposed to the outside, and an inclined face extending from the exposed face to the accommodating body toward the window.

In one implementation, the accommodating body includes a seating face extending in parallel with the exposed face from an inner circumferential face of the inclined face so as to allow at least a portion of the window to seat thereon.

In one implementation, the window includes a cover body disposed on a front face of the display so as to shield the display, and an extended portion protruding from the cover body toward the seating face and accommodated in the first sealing member.

In one implementation, the extended portion is disposed to be spaced apart from the inclined face by a certain distance such that the seating face is exposed to the first sealing member.

In one implementation, the extended portion extends from the cover body to the inner circumferential face of the inclined face. In one implementation, a thickness of the extended portion is smaller than a thickness of the inclined face.

In one implementation, the thickness of the extended portion is smaller than a gap between the exposed face and the seating face.

In one implementation, the laundry treating apparatus further includes a mounting portion mounted in the housing, wherein the display is seated on the mounting portion, and a diameter of the window is smaller than a diameter of the mounting portion.

In one implementation, the sealing member further includes a second sealing member for sealing the fixed body.

In one implementation, the second sealing member is accommodated in the fixed body and is made of an elastic member for sealing the fixed body.

In one implementation, the second sealing member includes a sealing body accommodated in the fixed body so as to seal the fixed body, a sealing body through-hole extending through the sealing body, wherein the control line passes through the sealing body through-hole, and a cut-out groove defined by cutting the sealing body such that the control line is inserted into and withdrawn from the sealing body through-hole.

In one implementation, the laundry treating apparatus further includes a casing having an encoder coupled with the manipulation portion and configured to receive the selection command installed therein, wherein the casing is fixed to a rear face of the cabinet, and the encoder includes a rotating portion coupled to the manipulation portion so as to rotate, and a fixing portion coupled to the casing so as to rotatably support the rotating portion.

In one implementation, the housing is coupled to the fixing portion to fix the display portion to a front face of the cabinet.

The present disclosure has the effect of ensuring the durability of the display portion even when the display portion having the liquid crystals fixed inside the rotating manipulation portion is disposed.

The present disclosure has the effect of blocking the inflow of the water or the foreign substances between the interior of the manipulation portion and the display portion.

The present disclosure has the effect of preventing the cover or the window that protects the display portion from deviating from the manipulation portion to the outside.

BRIEF DESCRIPTION OF THE DRAWINGS

FIG. 1 shows a home appliance system and an online system in which laundry treating apparatuses of the present disclosure are arranged.

FIG. 2 shows an embodiment of an internal structure of a laundry washing apparatus 10 and a mini apparatus 60.

FIG. 3 shows a structure of a laundry dry apparatus among laundry treating apparatuses of the present disclosure.

FIG. 4 shows a detailed structure of a water collecting portion 37, a heat exchanger 4, a washer 6, and the like.

FIG. 5 shows an embodiment of an internal structure of a laundry dry apparatus 20 of the present disclosure.

FIG. 6 shows a structure in which, when the laundry treating apparatus includes the laundry washing apparatus 10, the laundry dry apparatus 20, and the auxiliary apparatus 60, the apparatuses may be in communication with each other.

FIG. 7 shows an embodiment of a control panel P that may be applied to a laundry treating apparatus of the present disclosure.

FIG. 8 shows a structure in which a control panel is coupled to a front panel.

FIG. 9 shows an internal structure of a control panel.

FIG. 10 shows a structure of an encoder.

FIG. 11 shows a structure of manipulation portion and a display portion.

FIG. 12 shows a detailed configuration of manipulation portion and a display portion.

FIG. 13 shows an embodiment of a sealing member.

FIG. 14 shows an embodiment of utilization of the control panel.

FIG. 15 shows a structure of a display portion of the present disclosure.

FIG. 16 shows a foreign substance inflow prevention structure of a display portion of the present disclosure.

FIG. 17 shows an embodiment of a display portion of the present disclosure.

FIG. 18 shows another embodiment of a display portion of the present disclosure.

FIG. 19 shows another embodiment of a display portion of the present disclosure.

DETAILED DESCRIPTION

Hereinafter, embodiments disclosed in the present specification will be described in detail with reference to the accompanying drawings. In the present specification, even in different embodiments, the same and similar reference numerals are assigned to the same and similar components, and the description thereof is replaced with the first description. As used herein, the singular expression includes the plural expression unless the context clearly dictates otherwise. In addition, in describing the embodiments disclosed herein, when it is determined that a detailed description of a related known technology may obscure the gist of the embodiments disclosed herein, a detailed description thereof will be omitted. In addition, the accompanying drawings are only for easy understanding of the embodiments disclosed in the present specification, and it should be noted that the technical idea disclosed in the present specification is not to be construed as being limited by the accompanying drawings.

FIG. 1 shows a home appliance system and an online system in which a laundry treating apparatus of the present disclosure is disposed.

The laundry treating apparatus of the present disclosure may include a laundry washing apparatus 10 that performs an arbitrary washing course or washing option that performs a washing cycle for removing foreign substances from laundry using water and detergent, and a mini apparatus 60 that is disposed near or beneath the laundry washing apparatus and performs the arbitrary washing course or washing option that performs the washing cycle for removing the foreign substances from the laundry using the water and the detergent.

The laundry washing apparatus 10 may be of a front load type in which the laundry is put into the laundry washing apparatus 10 from a front face thereof, and the mini apparatus 60 may be of a top load type in which the laundry is put into the mini apparatus 60 from a top face thereof.

As shown, the mini apparatus 60 may be disposed beneath the laundry washing apparatus 10 to increase a vertical level of a laundry inlet of the laundry washing apparatus 10. In this case, the mini apparatus 60 may be of a drawer type of being extended frontwards such that a laundry inlet thereof into which the laundry is put is exposed.

In addition, the mini apparatus 60 may be disposed on top of the laundry washing apparatus 10. Accordingly, a user may easily access the mini apparatus 60.

In one example, the laundry treating apparatus of the present disclosure may include a laundry drying apparatus 20 that performs an arbitrary drying course or drying option that dries the laundry containing moisture after the washing is completed in the laundry washing apparatus 10 or the mini apparatus 60.

The user may arrange the laundry washing apparatus 10 and the laundry drying apparatus 20 among the laundry treating apparatus of the present disclosure together in the room, and may include all of the components of the laundry treating apparatus by additionally including the mini apparatus 60.

Accordingly, the mini apparatus 60 may wash laundry that has a relatively small volume and is frequently washed, such as underwear and baby clothes. In addition, the laundry washing apparatus 10 may wash laundry that has a large volume and is infrequently washed, such as jeans and quilts.

In one example, at least one of the laundry washing apparatus 10, the laundry drying apparatus 20, and the mini apparatus 60 may access an Internet network via a router (AP) 30. At least one of the laundry washing apparatus 10, the laundry drying apparatus 20, and the mini apparatus 60 may have a communication module to connect to the router, and a server 50 provided by a producer who produced the laundry treating apparatus may recognize the laundry washing apparatus 10, the laundry drying apparatus 20, and the mini apparatus 60 via port information of the router 30 and register and control the laundry washing apparatus 10, the laundry drying apparatus 20, and the mini apparatus 60.

When the user has an external terminal 40 equipped with a communication module, such as a smartphone, the user may access the server 50 via the Internet network with the external terminal 40 to control at least one of the laundry washing apparatus 10, the laundry drying apparatus 20, and the mini apparatus 60.

In addition, the user may register at least one of the laundry washing apparatus 10, the laundry drying apparatus 20, and the mini apparatus 60 to the server 50 via the external terminal 40.

In addition, when there is notification information or there is an update of the course or the option for at least one of the laundry washing apparatus 10, the laundry drying apparatus 20, and the mini apparatus 60, the server 50 may notify the user with the external terminal 40.

In one example, the laundry washing apparatus 10, the laundry drying apparatus 20, and the mini apparatus 60 may be configured to be in communication with each other.

One of the laundry washing apparatus 10, the laundry drying apparatus 20, and the mini apparatus 60 may be configured to be in communication with the other two via the router 30 and the server 50. To this end, each of the laundry washing apparatus 10, the laundry drying apparatus 20, and the mini apparatus 60 may include the communication module such as WIFI.

In addition, the laundry washing apparatus 10, the laundry drying apparatus 20, and the mini apparatus 60 may be configured to be in communication with each other without via the server 50. For example, the laundry washing apparatus 10, the laundry drying apparatus 20, and the mini apparatus 60 may be configured to be in communication with each other via a Bluetooth communication module.

The laundry washing apparatus 10, the laundry drying apparatus 20, and the mini apparatus 60 may be configured to be in communication with each other to share the states thereof with each other and to display each other's states.

For example, the user may identify the states of the laundry drying apparatus 20 and the mini apparatus 60 via the laundry washing apparatus 10. Therefore, even when the laundry drying apparatus 20 and the mini apparatus 60 are disposed to be spaced apart from the laundry washing apparatus 10 or are disposed at positions where the laundry drying apparatus 20 and the mini apparatus 60 are not visible when the user looks at the laundry washing apparatus 10, the user may display the states of the laundry drying apparatus 20 and the mini apparatus 60 via the laundry washing apparatus 10.

The laundry washing apparatus 10, the laundry drying apparatus 20, and the mini apparatus 60 may be configured to share names of a course or option thereof, a selected state of the course or option thereof, a executed state of the course or option thereof, a completion state of the course or option thereof, and an error or notification state thereof with each other or display each other's names and states of the courses or options and error or notification states.

In addition, one of the laundry washing apparatus 10, the laundry drying apparatus 20, and the mini apparatus 60 may be configured to manipulate the other two with a manipulation portion thereof for receiving a command.

The laundry washing apparatus 10, the laundry drying apparatus 20, and the mini apparatus 60 may transmit and receive control commands to and from each other via the respective communication modules thereof or the server 50.

Accordingly, even when the laundry washing apparatus 10, the laundry drying apparatus 20, and the mini apparatus 60 are spaced apart from each other, the user may control another device with one device, thereby improving convenience.

FIG. 2 shows an embodiment of internal structures of the laundry washing apparatus 10 and the mini apparatus 60.

Unlike the drawing, the laundry washing apparatus 10 and the mini apparatus 60 may be independently constructed to be separated from each other.

The laundry washing apparatus 10 may include a cabinet 1 that forms an appearance of the laundry washing apparatus, a tub 2 that is accommodated in the cabinet 1 and stores water therein, a drum 3 that is rotatably disposed in the tub 2 and stores water therein, a driver 32 that is coupled to the tub 2 to rotate the drum 3, a water supply 23 that is constructed to supply water to the tub 2, and a drainage 25 constructed to drain water of the tub 2.

Each of the tub 2 and the drum 3 may have the laundry inlet for putting the laundry into the laundry washing apparatus in a front face thereof, and the cabinet 1 may further include a door 132 for opening and closing the laundry inlet.

The driver 32 may include a stator 321 coupled to a rear face of the tub 2, a rotor 322 rotated by the stator 321, and a rotation shaft 323 coupled to the rotor 322 to rotate the drum 3.

The water supply 23 may include a water supply pipe 231 that allows an external water supply source and the tub 2 to be in communication with each other, and a water supply valve 232 that opens and closes the water supply pipe 231.

In one example, the water supply 23 may further include a detergent box that is able to be extended forwardly of the cabinet 1 and is constructed to put detergent into the tub 2, and the water supply pipe 231 may be in communication with the detergent box.

The drainage 25 may include a drain pipe 251 disposed below the tub 2, and a drain pump 252 coupled to the drain pipe 252 to provide power for discharging water.

The laundry washing apparatus 10 may further include a support 22 that supports the tub 2 to the cabinet 1, and a heater H1 that heats water inside the tub 2.

In addition, the laundry washing apparatus 10 may further include a hot air supply Ha constructed to supply hot air to the tub 2.

In one example, the laundry washing apparatus 10 may include a control panel P or a washing controller that receives a command for displaying or controlling the state of the laundry washing apparatus 10. The control panel P may be disposed coupled to the cabinet 1.

In addition, the control panel P may operate at least one of the driver 32, the water supply valve 232, the drain pump 252, the heater H1, and the hot air supply Ha to perform the arbitrary washing course and washing option for removing the foreign substances from the laundry. The washing course and the washing option may be composed of a series of control methods capable of performing all of a washing cycle, a rinsing cycle, and a dehydration cycle.

The mini apparatus 60 may include a mini cabinet 1C that forms an appearance of the mini cabinet, a mini tub 2C that is accommodated in the mini cabinet 1C and stores water therein, a mini drum 3C that is rotatably disposed in the mini tub 2C and stores water therein, a mini driver 32C that is coupled to the mini tub 2C to rotate the mini drum 3C, a mini water supply 23C constructed to supply water to the mini tub 2C, and a mini drainage 25C constructed to drain water of the mini tub 2C.

The mini cabinet 1C may be disposed beneath the cabinet 1 to support the cabinet 1. It is not excluded that the mini cabinet is placed on top of the cabinet 1.

The mini cabinet may be formed integrally with the cabinet 1.

Each of the mini tub 2C and the mini drum 3C may have the laundry inlet for putting the laundry into the mini apparatus in a top face thereof, and the mini laundry cabinet 1C may further include a mini door 132C for opening and closing the laundry inlet.

The mini driver 32C may include a mini stator 321C coupled to a bottom face of the mini tub 2C, a mini rotor 322C rotated by the mini stator 321C, and a mini rotation shaft 323C coupled to the mini rotor 322C to rotate the mini drum 3C.

The mini water supply 23C may include a mini water supply pipe 231C that allows the external water source and the mini tub 2C to be in communication with each other, and a mini water supply valve 232C that opens and closes the mini water supply pipe 231C.

In one example, the mini water supply 23C may further include a mini detergent box that is able to be extended forwardly of the cabinet 1 and is constructed to put the detergent into the mini tub 2C, and the mini water supply pipe 231C may be in communication with the detergent box.

The mini drainage 25C may include a mini drain pipe 251C disposed below the mini tub 2C, and a mini drain pump 252C coupled to the mini drain pipe 252C to provide power for discharging water.

The mini apparatus 60 may further include a mini support 22C that supports the mini tub 2C to the mini cabinet 1C, and a mini heater H2 that heats water inside the mini tub 2C.

In addition, the mini apparatus 60 may further include a hot air supply Hb constructed to supply hot air to the mini tub 2C.

In one example, the mini apparatus 60 may include a mini control panel PC or a mini controller that receives a command for displaying or controlling the state of the mini apparatus 60. The mini control panel PC may be disposed coupled to the mini cabinet 1C.

In addition, the mini control panel PC may operate at least one of the mini driver 32C, the mini water supply valve 232C, the mini drain pump 252C, the mini heater H2, and the mini hot air supply HaC to perform the arbitrary washing course and washing option for removing the foreign substances from the laundry. The washing course and the washing option may be composed of a series of control methods capable of performing all of the washing cycle, the rinsing cycle, and the dehydration cycle.

The mini apparatus 60 may further include a drawer D that is able to be extended forwardly of the mini cabinet 1*c* and accommodates the mini tub 2*c* therein. The drawer D may include a front cover DC at a front face thereof to open and close an entrance through which the drawer D is extended from the mini cabinet 1C.

The mini control panel PC may be disposed on the front cover DC.

FIG. 3 shows a structure of the laundry drying apparatus 20 of the laundry treating apparatus of the present disclosure.

The laundry drying apparatus 20 may include a drying cabinet 1A, a drying drum 2A that is rotatably disposed inside the drying cabinet to provide a space for storing the laundry, a circulation flow path 3A that forms a flow path for re-supplying air discharged from the drying drum 2 to the drying drum 2A, and a heat exchanger 4 that dehumidifies and heats air introduced into the circulation flow path 3A and then re-supplies dehumidified and heated air to the drying drum 2A.

When the drying drum 2A is formed as a cylindrical drum body 21A with open front face and rear face, a first support 17 that rotatably supports the front face of the drying drum 2A and a second support 19A that rotatably supports the rear face of drying drum 2A may be disposed inside the cabinet 1A.

The first support 17 may include a first fixed body 171 fixed inside the drying cabinet 1A, a drum laundry inlet 173 defined to extend through the first fixed body to allow the laundry inlet 111 and an interior of the drum body 21A to be in communication with each other, and a first support body 175 disposed on the first fixed body 171 and inserted into a front face (a first open face) of the drum body 21A.

The first fixed body 171 may be in any shape as long as the drum laundry inlet 173 and the first support body 175 are able to be disposed. The first support body 175 may be formed in a pipe shape protruding from the first fixed body 171 toward the drying drum body 21A. A diameter of the first support body 175 may be larger than a diameter of the drum laundry inlet 173, and may be smaller than a diameter of a front face of the drying drum body 21A. In this case, the drum laundry inlet 173 will be located inside the space defined by the first support body 175.

The first support 17 may further include a connection body 177 that connects the laundry inlet 111 and the drum laundry inlet 173 to each other. The connection body 177 may be formed in a pipe shape extending from the drum laundry inlet 173 toward the laundry inlet 111. The connection body 177 may have an air outlet 178 in communication with the circulation flow path 3A.

The air outlet 178, as a passage that allows air inside the drying drum body 21A to flow to the circulation flow path 3, may be defined as a through-hole defined to extend through the connection body 177.

The second support 19A may include a second fixed body 191 fixed inside the cabinet 1A, and a second support body 195 disposed on the second fixed body 191 and inserted into a rear face (a second open face) of the drum body 21A. The second support 19 includes an air inlet 198 defined to extend through the second fixed body 191 to allow an interior of the drum body 21 and an interior of the drying cabinet 1A to communicate with each other. In this case, a duct 3A may be constructed to connect the air outlet 178 and the air inlet 198 to each other.

The cylindrical drum body 21A with an empty interior may be rotated by various types of drying drivers. A case in which the drying driver 82,83,85 includes a motor 82 fixed inside the drying cabinet 1A, a pulley 85 rotated by the motor, and a belt 83 that connects a circumferential face of the pulley 85 and a circumferential face of the drum body 21A to each other is shown as an example.

In one example, the drying driver may be disposed on a rear face of the drying drum 2A to directly rotate the drum 2A. A rotation shaft of the drying driver 82,83,85 may be directly coupled to the drum 2A to rotate the drying drum 2A.

In this case, the second support 19A may support the drying driver 82,83,85 to be located on a rear face or at a center of the drying drum 2A.

In one example, a separate reducer may be disposed between the drying driver 82,83,85 and the drying drum 2A. In this case, a rotation shaft from the reducer may be directly coupled to a center of the rear face of the drum 2A, and the reducer may be coupled to and supported by the second support 19.

In this regard, the drying driver 82,83,85 may freely change a rotation speed and a rotation direction of the drum 2A.

The first support 17 may have a first roller 179 that rotatably supports the circumferential face of the drum body 21A, and the second support 19 may have a second roller 199 that rotatably supports the circumferential face of the drum body.

The circulation flow path 3A may include a duct in communication with the drum 2. The duct 3A may be in communication with the drying drum 2A, so that it may be considered that the duct 3A forms a circulation flow path in which air discharged from the drying drum passes the heat exchanger 4 and is re-introduced into the drum 2A.

The duct 3A may include an exhaust duct 31A connected to the air outlet 178, a supply duct 33A connected to the air inlet 198, and a connection duct 35A that connects the exhaust duct and the supply duct to each other.

The heat exchanger 4 may be formed as various apparatuses as long as the dehumidification and the heating of air introduced into the duct 3A may be sequentially performed. For example, the heat exchanger 4 may be formed as a heat pump system.

The heat exchanger 4 may include a fan 49 that allows air to flow along the duct 3A, a first heat exchanger (a heat absorber) 41 that removes moisture from air introduced into the duct 3A, and a second heat exchanger (a heater) 43 that is disposed inside the duct 3A to heat air that has passed through the first heat exchanger 41.

The heat absorber 41 may be formed as an evaporator that absorbs heat, and the heater 43 may be formed as a condenser that emits heat.

The fan 49 may include an impeller 491 disposed inside the duct 3A, and an impeller motor 493 that rotates the impeller 491 (see FIG. 4). The impeller 491 may be disposed in any of the exhaust duct 31A, the connection duct 35A, and the supply duct 33A. The impeller 491 may be disposed in the supply duct 33A.

The heat absorber 41 is formed with multiple metal plates disposed along a width direction (a Y-axis direction) of the connection duct 35A or a height direction (a Z-axis direction) of the connection duct, and the heater 43 may be formed with multiple metal plates disposed along the width direction of the connection duct or the height direction of the connection duct. The heat absorber 41 and the heater 43 are sequentially arranged inside the connection duct 35A in a direction from the exhaust duct 31A toward the supply duct 33A, and are connected to each other via a refrigerant pipe 48 that forms a circulation flow path of a refrigerant.

The refrigerant moves along the refrigerant pipe 48 by a compressor 45 located outside the duct 3A, and the refrigerant pipe 48 has a pressure regulator 47 that adjusts a pressure of the refrigerant that has passed through the heater 43.

The heat absorber 41 is means for cooling air and evaporating the refrigerant by transferring the heat of air introduced into the exhaust duct 31A to the refrigerant. The heater 43 is means for heating air and condensing the refrigerant by transferring the heat of the refrigerant that has passed through the compressor 45 to air. In this case, the moisture contained in air will be collected on a bottom face of the connection duct 35A along a surface of the heat absorber 41 when passing through the heat absorber 41.

In order to collect water removed from air passing through the heat absorber 41, the laundry drying apparatus 20 has a water collecting portion.

The water collected in the water collecting portion may be collected in a water storage 7 and discharged all at once later. The water storage 7 may include a water storage tank 72 that is detachably disposed in the cabinet 1 to provide a space for storing water, and an inlet 722 defined to extend through the water storage tank 72 to introduce water discharged from a water storage supply pipe 633 into the water storage tank 72.

The water storage tank 72 may be formed as a tank in a form of a drawer extended from the cabinet 1. In this case, the front panel 11A of the cabinet must have a water storage mounting hole or tank hole into which the water storage tank 72 is inserted. A water storage panel 71 is fixed to a front face of the water storage tank 72. The water storage panel 71 may be detachably coupled to the water storage mounting hole or tank hole 115 to form a portion of the front panel 11A.

The water storage panel 71 may further include a groove 711 into which a user's hand is inserted. In this case, the water storage panel 71 will also perform a function of a handle for extending or retracting the water storage tank 72 from or into the cabinet.

The inlet 722 may be defined to receive water discharged from a nozzle 722*a* fixed to the drying cabinet 1A. The nozzle 722*a* may be fixed to a top panel 13 of the cabinet so as to be positioned above the inlet 722 when the storage body 72 is inserted into the cabinet 1.

In the water storage 7 having the above structure, the user may discard water inside the water storage tank 72 by extending the water storage tank 72 from the cabinet 1 and then inverting or tilting the water storage tank 72 in a direction in which the inlet 722 is directed. A communication hole 721 defined to extend through a top face of the storage body 72 may be further defined such that water inside the water storage tank 72 is easily discharged through the inlet 722.

In one example, the heat exchanger 4 is constructed to condense the moisture in air circulating in the heat absorber 41. Therefore, even when the air circulates in the drum 2A, the moisture is removed by the heat absorber 41, so that the laundry inside the drum 2A may be continuously dried.

The moisture condensed in the heat absorber 41 may be first collected in the water collecting portion 37A and then collected secondary in the water storage 7. The water collecting portion 37A may be located inside the connection duct 35, and may be separately disposed in a space spaced apart from the connection duct 35.

FIG. 4 shows a detailed structure of the water collecting portion 37A, the heat exchanger 4, and a washer 6.

The water collecting portion 37A may be formed as a water collecting body 371A fixed to a bottom face of the connection duct 35A and in communication with the interior of the connection duct. A heat exchanger support 372A may be further disposed inside the water collecting body 371A such that the heat absorber 41 and the heater 43 do not come into contact with water (condensed water) stored in the water collecting body 371A. The heat exchanger support 372A may include a support plate 373A in contact with the heat absorber 41 and the heater 43, a spacer 375A that maintains a gap between the support plate 373 and a bottom face of the water collecting body 371A, and a support plate through-hole 376A defined to extend through the support plate 373A.

The support plate through-hole 376A may be defined only in a space in which the heat absorber 41 is supported of the space provided by the support plate 373A, and may be defined in each of the space in which the heat absorber is supported and a space in which the heater is supported. When the support plate through-hole 376A is also defined in a bottom face of the heater 43, water flowed to the heater 43 along the support plate 373A may be discharged to the water collecting portion 371A (to prevent a decrease in heat transfer efficiency that occurs when the heater comes into contact water).

In order to minimize the foreign substances (lint and the like) discharged from the drying drum body 21A being stacked in the heat absorber 41 and the heater 43, the laundry drying apparatus 20 may further include filtration means for filtering air.

Second filtration means 8 may be formed as means for filtering air introduced into the exhaust duct 31A from the drying drum body 21A, and first filtration means 5 may be located between the second filtration means 8 and the heat absorber 41 and be formed as means for filtering air that has passed through the second filtration means. A diameter of a filtration hole defined in the first filtration means 5 may be set smaller than a diameter of a filtration hole defined in the second filtration means 8.

The second filtration means 8 may include a frame 81 that is detachably inserted into the exhaust duct 31A through the air outlet 178, and a filter (a fourth filter) 83 disposed in the frame to filter air.

The first filtration means 5 may be detachably disposed in the connection duct 35. In this case, the front panel 11 of the cabinet may have a filter mounting hole from which the first filtration means 5 is withdrawn and a mounting hole door that opens and closes the filter mounting hole, and the duct 3A may have a duct through-hole 34 (see FIG. 3) into which the first filtration means 5 is inserted. Accordingly, the user may remove the foreign substances remaining in the first filtration means 5 and wash the first filtration means after separating the first filtration means 5 from the laundry treating apparatus as needed.

The first filtration means 5 may include a filtration means body 51, 53, and 55 inserted into the filter mounting hole and the duct through-hole 34 and positioned between the second filtration means 8 and the heat absorber 41, and filters 531, 551, and 571 disposed in the filtration means body to filter fluid (air and water) flowing to the heat absorber 41 and the water collecting portion 371A.

The filtration means body may be formed in various forms depending on a shape of a cross-section (a Y-Z plane and a X-Z plane) of the connection duct 35A. FIG. 1 shows an example of a case in which the filtration means body is formed in a shape similar to a hexahedron.

In this case, the filtration means body may include a front face 51 formed in a shape capable of closing the duct through-hole 34, a rear face 53 positioned between the front face and the heat absorber 41, a bottom face 55 constructed to connect the front face and the rear face with each other, and a first side face 57 and a second side face 58 that form a left side face and a right side face of the filtration means body.

The front face 51 may have a lock 511 removably coupled to a lock fastening portion 16 disposed in the cabinet. The lock 511 may be formed as a bar rotatably coupled to the front face 51 of the filtration means body, and the lock fastening portion may define a groove in which a free end of the bar is accommodated. Preferably, the locks 511 are respectively disposed on opposite sides of the front face 51, and the lock fastening portions 16 are respectively disposed on opposite sides of the filter mounting hole.

To facilitate insertion of the filtration means body into the connection duct 35A or removal of the filtration means from the connection duct 35A, the front face 51 may further include a handle 511.

The rear face 53 and the bottom face 55 may respectively have a first filter 531 and a second filter 551 for filtering the fluid (air and water) introduced into the filtration means body. The rear face 53 has a rear face through-hole defined therein for allowing an interior of the filtration means body and the internal space of the duct 3A to be in communication with each other, and the first filter 531 is disposed in the rear face through-hole. The bottom face 55 has a bottom face through-hole for allowing the interior of the filtration means body and the internal space of the duct 3A to be in communication with each other, and the second filter 551 is disposed in the bottom face through-hole. Therefore, the first filter 531 is means for filtering the fluid (air and water) supplied to the heat absorber 41, and the second filter 551 is means for filtering the fluid supplied to the water collecting portion 371A.

The first side face 57 and the second side face 58 may be constructed to connect the front face 51, the rear face 53, and the bottom face 55 to each other.

The first filtration means 5 having the above structure may be in communication with the exhaust duct 31A through the top face or the second side face 58 of the filtration means body. FIG. 1 shows a case in which the first filtration means 5 is connected to the exhaust duct 31A through a top face through-hole defined to extend through the top face of the filtration means body and a side face through-hole defined to extend through the second side face 58 as an example.

The first filter 531 may be inclined in an angle range from 90 degrees to 100 degrees toward a front face of the heat absorber 41 based on the bottom face 55 of the filtration means body. This is to allow the foreign substances remaining in the first filter to easily move to the bottom face 55 when water is injected into the first filter 531 via the washer 6 to be described later.

The second filter 551 may be inclined downward in an angle range from 10 to 20 degrees from the front face 51 toward the first filter 531 (The second filter may be inclined upward in an angle range from 10 to 20 degrees in a direction from a lower end of the first filter to the filter mounting hole). When the second filter 551 is inclined downward toward the first filter 531, because a connection point of the first filter 531 and the second filter 551 will be the lowest point in the space provided by the first filtration means, the foreign substances of the first filtration means 5 may be concentrated at the connection point of the first filter 531 and the second filter 551. When the foreign substances are concentrated at the connection point of the first filter 531 and the second filter 551, the user will be able to more easily remove the foreign substances inside the first filtration means 5.

However, when the foreign substances are concentrated at the connection point of the first filter 531 and the second filter 551, there may be a situation in which a long time is required for water sprayed via the washer 6 to be discharged to the water collecting portion 371. In order to solve such problem, a bypass hole for allowing the interior of the first filtration means 5 and the water collecting portion 371 to be in communication with each other, and a third filter 571 disposed in the bypass hole may be further disposed.

The bypass hole and the third filter 571 may be defined at a position higher than an uppermost end of the second filter 551 and lower than an uppermost end of the first filter 531. Therefore, the laundry treating apparatus may minimize a phenomenon in which water sprayed to the first filtration means 5 is not able to be recovered at the water collecting portion 371 by the foreign substances remaining in the first filtration means 5.

In one example, the laundry drying apparatus 20 may further include the washer 6 that washes the first filtration means 5 using water stored in the water collecting portion 371A. That is, water stored in the water collecting portion 371A may be separately collected into the water storage 7 or may be selectively flowed to the washer 6.

The washer 6 may be formed as means for washing at least one of the first filter 531, the second filter 551, the third filter 571, and the heat absorbers 41 by spraying water stored in the water collecting portion 371A to the first filtration means 5. The washer 6 may include a spray 65 disposed in the duct 3A to supply water to the first filtration means 5, and a washing pump 61 that allows water stored in the water collecting portion 371A to flow to the spray 65.

The washing pump 61 may be connected to the water collecting portion 371A via a first connection pipe 611, and may be connected to the spray 65 via a second connection pipe 613. When the laundry treating apparatus is constructed to allow water of the water collecting portion 371A to flow to the spraying portion 65 and the water storage 7 with only one washing pump 61, the laundry drying apparatus 20 may further include flow path switching portion 63. In this case, the flow path switching portion 63 may be connected to the washing pump 61 via the second connection pipe 613, the spray 65 may be connected to the flow path switching portion 63 via a spray supply pipe 631, and the water storage 7 may be connected to the flow path switching portion 63 via the water storage supply pipe 633.

In this case, the water storage supply pipe 633 should connect the nozzle 722*a* and the flow path switching portion 63 to each other.

The flow path switching portion 63 includes a valve for controlling opening and closing of the spray supply pipe 631 and opening and closing of the water storage supply pipe 633. Therefore, the laundry drying apparatus 20 may control the valve disposed in the flow path switching portion 63 to supply water stored in the water collecting portion 371A to the spray 65 or to the water storage 7.

A case in which the spray 65 includes a duct through-hole 651 defined to extent through the connection duct 35 and to which the spray supply pipe 631 is connected, a first guide 653 that guides water supplied from the duct through-hole to the first filter 531, and a second guide 655 that guides at least a portion of water supplied through the first guide 653 to the front face of the heat absorber 41 is shown as an example. In this case, the second guide 655 may be disposed as means for allowing water to be supplied to the front face of the heat absorber 41 via the first filter 531. That is, the first filter 531 may be disposed between the first guide 653 and the second guide 655 when the first filtration means 5 is fixed to the connection duct 35A, and the second guide 655 may be formed as an inclined face inclined downward toward the first filter 531 from a top face of the connection duct 35.

The first guide 653 may further include a guide through-hole 654. The guide through-hole 654, as a hole defined to extend through the first guide 653, may allow water introduced into the duct through-hole 651 to be supplied to a front area of the heat absorber 41 through the guide through-hole 654. The front area of the heat absorber means an area positioned at a side facing toward the first filter 531 based on a vertical line passing through a center of the heat absorber 41.

In one example, it is preferable that the laundry treating apparatus of the present disclosure includes water collecting portion water level sensing means 92 that measures a water level of the water collecting portion 371A and transmits the water level to the controller. When the water collecting portion water level sensing means 92 is disposed, the laundry treating apparatus may determine a time point of allowing water stored in the water collecting portion 371A to flow to the storage body 72. Therefore, water of the water collecting portion 371A may be prevented from flowing back into the connection duct 35A.

The water collecting portion water level sensing means 92 may be formed as any device capable of sensing the water level inside the water collecting portion 371A. FIG. 3 shows a sensor with multiple electrodes having different lengths (multiple electrodes electrically connected based on the water level) as an example.

The laundry drying apparatus 20 may have dryness sensing means to determine a time point to stop operation of the heat exchanger 4 by determining a dryness of the laundry. The dryness sensing means may be formed as at least one of an electrode sensor 95 constructed to be in contact with the laundry to measure an amount of moisture contained in the laundry, and a humidity sensor for measuring humidity of air introduced into the duct 3A from the drum 3.

The electrode sensor may include a first electrode 951 and a second electrode 953 that may be fixed to the first fixed body 171 and may be in contact with the laundry inside the drum body 21A. As the dryness increases, the amount of moisture contained in the laundry will decrease (an electrical resistance of the laundry will increase), so that the laundry drying apparatus 20 may determine the dryness of the laundry by observing an electrical resistance measured when the two electrodes 951 and 953 are connected to each other via the laundry. In one example, as the dryness of the laundry increases, the amount of moisture contained in air introduced into the duct 3A will decrease, so that the laundry drying apparatus 20 may determine the dryness of the laundry by observing the humidity of air introduced into the duct 3A via the humidity sensor.

In addition, the laundry drying apparatus 20 may further include temperature sensing means 96 for measuring a temperature of air introduced into the duct 3A. The temperature sensing means 96 may be fixed to the top face of the connection duct 35A and positioned between the first filter 531 and the second filter 551.

FIG. 5 shows an embodiment of an internal structure of the laundry dry apparatus 20 of the present disclosure.

The driver 28 may be directly fastened to a rear face of the drying drum 2A. The drying driver 28 may be disposed on the second support 19 to directly rotate the drying drum 2A.

The drying driver 28 may include a stator supported by the second support 19, a rotor rotated by the stator, and a rotation shaft.

The drying driver 28 may be separately coupled to a reducer 28A, and the reducer 28A may be coupled to a center (a rotation center) of a rear face of the drying drum 2A to rotate the drying drum 2A.

Accordingly, the reducer 28A may increase a torque while reducing an RPM of the rotation shaft.

The steam apparatus 200 may be disposed to be fixed to the front panel 11 or the first support supporting the drum 2 for space utilization. In addition, the steam apparatus 200 may be disposed adjacent to a corner of the cabinet 1.

The internal supply 400 may include a water tank 420 for storing water, a water pump 430 for supplying power for supplying the water stored in the water tank 420 to the steam apparatus 200, and a tank housing 410 that provides a space in which the water pump 430 and the water tank 420 are installed.

The tank housing 410 may be formed in a box shape with an open top face, and may extend along a front and rear direction of the cabinet 1 such that the water tank 420 may be disposed in a front portion of the cabinet 1 and the water pump 430 may be disposed in a rear portion of the cabinet 1.

The tank housing 410 may include a tank mounting portion 411 in which the water tank 420 is detachably mounted, and a pump mounting portion 412 in which the water pump 430 may be mounted. The tank mounting portion 411 and the pump mounting portion 412 may be formed in a recessed shape to prevent water leaking from the water tank 420 or the water pump 430 from leaking to the drying drum 2A or the like.

In addition, the tank housing 410 may further include a partition wall 413 partitioning the tank mounting portion 411 and the pump mounting portion 412 from each other.

Accordingly, the water tank 420 may be easily mounted in and detached from the tank housing 410. The partition wall 413 may also serve to collect residual water in the tank mounting portion 411 or residual water in the pump mounting portion 412 such that the residual water does not flow to another place.

An extension pipe 416 for allowing the water tank 420 and the water pump 430 to be in communication with each other may be installed in the partition wall 413. A valve structure may be installed on the extension pipe 416 to prevent leakage of water even when the water tank 420 is removed from the tank mounting portion 411.

The extension pipe 416 may extend from the partition wall 413 toward the water pump 430 or toward the water tank 420.

In one example, the tank housing 410 may be formed such that the pump mounting portion 412 is disposed closer to the steam apparatus 200 than the tank mounting portion 411. Accordingly, a flow path from the water tank 420 to the steam apparatus 200 may become simplified.

The tank housing 410 may be formed such that the tank mounting portion 411 and the pump mounting portion 412 are arranged along a front and rear direction of the cabinet.

The water supply 300 may include a coupling portion capable of fixing the tank housing 410 to at least one of the support bar 440 and one side face of the cabinet.

A rotating drying drum 2A is disposed inside the drying cabinet 1. Accordingly, the components arranged inside the cabinet 1 need to be spaced apart from the drying drum 2A. Therefore, it is necessary to prevent the water supply 300 and the steam apparatus 200 from coming into contact with the drum 2. For example, a steam guide pipe 230 for supplying steam from the steam apparatus 200 to the drum 2, the direct water pipe 510 for supplying water to the steam apparatus 200, or the like needs to be blocked from coming into contact with the drying drum 2A.

It is necessary to support not only the water tank 420 and the water pump 430 but also a load of water accommodated in the water tank 420.

Therefore, the laundry treating apparatus of the present disclosure may include a support bar 440 for supporting the steam apparatus 200 and the water supply 300 to prevent the steam apparatus 200 and the water supply 300 from coming into contact with the drum, and supporting the steam apparatus 200 and the water supply 300 inside the drying cabinet.

The support bar 440 may be constructed to support at least a portion of the steam apparatus 200 or at least a portion of the water supply 300. In addition, the support bar 440 may fix or support the tank housing 410 to the drying cabinet.

The support bar 440 may be formed in a shape of a bar having both ends respectively coupled to the drying front panel 11 and the drying rear panel 12. Accordingly, the support bar 440 may support a load of the tank housing 410 as well as fix the drying front panel 11 and the drying rear panel 12. The support bar 440 may be spaced apart from the drying side panel 14 by a predetermined distance and coupled to the drying front panel 11 and the drying rear panel 12. In one example, the both ends of the support bar 440 may be coupled to the cabinet 1, but remaining portion thereof may be disposed at a lower position than an upper portion of the side face of the cabinet 1. Accordingly, the support bar 440 may be spaced apart from the top panel 13 to prevent interference with the top panel 13. In addition, a space capable of supporting some components of the water supply 300 and the steam apparatus 200 may be defined between the support bar 440 and the top panel 13.

An excessive extension of a width of the tank housing 410 may be prevented by the support bar 440.

In one example, although not shown, the tank housing 410 may further include a mounting sensor capable of sensing mounting of the water tank 420 on an inner face thereof. The mounting sensor may be formed as a weight sensor, and may be configured to distinguish whether the weight is small or great.

The mounting sensor may be connected to the drying control panel PA to transmit information on whether the water tank 420 is mounted and an amount of water accommodated in the water tank 420.

The internal supply 400 may include a pump discharge pipe 433 for discharging water from the pump housing 430 to the steam apparatus 200.

The external supply 500 may include a direct water valve 520 seated on the second support 19A or the drying rear panel 12, and a direct water pipe 510 constructed to supply water from the direct water valve 520 to the steam apparatus 200.

The direct water pipe 510 may extend from the drying rear panel 12 to the steam apparatus 200, and the direct water valve 520 may be constructed to open and close the direct water pipe 510. The direct water pipe 510 may extend from the direct water valve 520 to the steam generator 210 across the support bar 440. In this regard, at least a portion of the direct water pipe 510 may be supported by the support bar 440 to prevent contact with the drying drum 2A.

The support bar 440 may be disposed between the direct water valve 520 and the water tank 430.

In addition, the direct water valve 520 may be seated on the drying rear panel 12 or the second support 19A to be exposed to the outside, and the direct water pipe 510 may extend from the direct water valve 520 toward the steam apparatus 200. Accordingly, the external supply 500 may supply water to the steam apparatus 200 in a direct water scheme from an external water supply source.

The steam apparatus 200 may receive water from each of the external supply 500 and the internal supply 400. However, when the steam apparatus 200 is constructed to receive water through respective pipes, a separate shape of the steam apparatus 200 must be manufactured, so that a flow path and a control method may become complicated.

To this end, the laundry treating apparatus of the present disclosure may further include a combining portion 600 for coupling the direct water pipe 510 with the pump discharge pipe 433. The combining portion 600 may be constructed such that both the water stored in the internal supply 400 and the water supplied in the direct water scheme from the external supply 500 are collected.

In addition, the combining portion 600 may be constructed to deliver the supplied water to the steam apparatus 200. The combining portion 600 may be formed as a three-way valve, or may be formed in a shape of a combining pipe in which three pipes are coupled to each other.

When the combining portion 600 is formed in the pipe shape, a check valve may be disposed in each of the external supply 500 and the internal supply 400 to prevent backflow. Specifically, a direct water check valve 511 for opening the direct water pipe 510 in one direction may be installed on the direct water pipe 510, and the pump discharge pipe 433 may have a discharge check valve 434 for opening the pump discharge pipe 433 in one direction.

In addition, the check valves may be disposed on the pump discharge pipe 433 and the direct water pipe 510, respectively. The external supply 500 may include an external check valve, and the internal supply 400 may include an internal check valve.

Accordingly, the water supplied to the direct water pipe 510 may be prevented from flowing back to the water pump 430, and the water supplied to the pump discharge pipe 433 may be prevented from flowing back to the direct water valve 510.

In one example, the combining portion 600 has a significant weight when formed as the valve or the combining pipe. In addition, when water passes through the combining portion 600, a considerable weight may be applied to the combining portion 600.

Accordingly, the combining portion 600 may be seated on the support bar 440.

The combining portion 600 and the support bar 400 may be coupled with each other using a separate fixing member to prevent the combining portion 600 from being separated from the support bar 400. Because the combining portion 600 is seated on the support bar 400, positions of the direct water pipe 510 and the pump discharge pipe 433 may also be stably fixed.

In one example, the steam apparatus 200 may include a water guide pipe 220 connected to the combining portion 600 to receive water from the water supply 300, a steam generator 210 that receives water from the water guide pipe 220 to generate steam, and a steam guide pipe 230 capable of guiding the steam generated by the steam generator 210 to the drying drum 2A or the duct 3A.

The steam generator 210 may be disposed below the drying drum 2A to stably receive water from the water supply 300 by gravity, and the generated steam may be stably moved to the drying drum 2A by a difference in density.

The steam guide pipe 230 may be constructed to be in communication with a gasket disposed on a front face of the drying drum 2A, or the first support. Accordingly, the steam guide pipe 230 may stably supply steam into the drying drum 2A without being in contact with the drying drum 2A.

In one example, the tank housing 410 may have a mounting sensor capable of sensing whether the water tank 420 is mounted. For example, the mounting sensor may be formed as a pressure sensor or the like.

In addition, a water level sensor capable of sensing a water level of the water tank 420 may be further disposed. For example, the water level sensor may be formed as a weight sensor. The mounted sensor or the water level sensor may also be controlled by the control panel 820, and may be configured to transmit a signal to the control panel 820.

In one example, the control panel P may indirectly identify the water level of the water tank 420 by temporarily driving the water pump 430 to sense a load applied to the water pump 430.

The water storage tank 72 may have a significantly larger volume than the water tank 430, and may be disposed to be spaced apart from the water tank 430 in order to prevent confusion of the user between the water storage tank 72 and the water tank 430.

The water tank 430 and the steam apparatus 200 may be disposed between the support bar 440 and one side face of the cabinet, and the water storage tank 72 may be disposed between the support bar 440 and the other side face of the cabinet.

Because the water tank 430 is coupled to the tank mounting portion 411, it may be seen that the tank mounting portion 411 is also disposed between the support bar 440 and one side face of the cabinet.

Consequently, the support bar 440 may be disposed between the water storage tank 72 and the steam generator 210, and may be disposed between the water storage tank 72 and the water tank 430.

FIG. 6 shows a structure in which, when the laundry treating apparatus includes the laundry washing apparatus 10, the laundry drying apparatus 20, and the mini or mini apparatus 60, the laundry washing apparatus 10, the laundry drying apparatus 20, and the a mini apparatus 60 may be in communication with each other.

The laundry washing apparatus 10 may include a washing control panel P configured to display information and to receive a command from the user.

The washing control panel P may include a displaying portion P8 capable of displaying the state of the laundry washing apparatus 10, an input means P9 capable of inputting the command to the laundry washing apparatus 10, and a washing speaker K1 capable of externally outputting a notification generated from the laundry washing apparatus 10. The laundry washing apparatus 10 may include a controller M1 that may perform the washing course and option including the driver, the water supply, the drainage, and the like of the laundry washing apparatus 10, and may include storage S1 that transmits the information to the controller M1 or stores a program to be used by the controller M1.

The input means P9 may be a concept including all components configured to receive the command of the user for the laundry washing apparatus 10, such as a manipulation portion P47, a power switch P46, an executing portion P47, a setting portion P2, and the like to be described later.

In addition, the laundry washing apparatus 10 may include a washing communication module T1. The washing communication module T1 may include a washing communication modem T11 including means of communication such as Wi-Fi or Bluetooth, a washing communication controller T12 configured to control the communication modem, and washing communication storage T13 that may transmit the received information to the controller M1 or may store a program for controlling the washing communication controller T12 when power to the washing controller M1 is cut off.

The washing communication module T1 may be configured to continuously receive the power even in a state in which power supply to the control panel P of the laundry washing apparatus 10 is cut off, and may be configured to maintain a state in communication with the external terminal 40 and the server 50.

In addition, the washing communication module T1 may be configured to be directly paired with a drying communication module T2 and a mini communication module T31 to be described later to maintain the communication state.

In addition, when the washing communication module T1 receives a power command for supplying power to the control panel p, the power may be controlled to be supplied to the control panel P.

The laundry drying apparatus 20 may include a drying control panel PA configured to display information and to receive a command from the user.

The drying control panel PA may include a drying displaying portion P8A capable of displaying the state of the laundry drying apparatus 20, a drying input means P9A capable of inputting the command to the laundry drying apparatus 20, and a drying speaker K2 capable of externally outputting a notification generated from the laundry drying apparatus 20. The laundry drying apparatus 20 may include a drying controller M2 that may perform the drying course and option of operating the driver and the like, and may include drying storage S2 that transmits the information to the drying controller M1 or stores a program to be used by the drying controller M1.

The drying input means P9A may be a concept including all components configured to receive the command of the user for the laundry washing apparatus 10, such as the manipulation portion P47A, the power switch P46A, the executing portion P47A, the setting portion P2A, and the like to be described later.

In addition, the laundry drying apparatus 20 may include a drying communication module T2. The drying communication module T2 may include a drying communication modem T21 including means of communication such as the Wi-Fi or the Bluetooth, a drying communication controller T22 configured to control the communication modem, and drying communication storage T23 that may transmit the received information to the drying controller M2 or may store a program for controlling the drying communication controller T22 when power to the drying controller M2 is cut off.

The drying communication module T2 may be configured to continuously receive the power even in a state in which power supply to the drying control panel PA of the laundry drying apparatus 20 is cut off, and may be configured to maintain a state in communication with the external terminal 40 and the server 50.

In addition, the drying communication module T2 may be configured to be directly paired with the communication module T1 and the mini communication module T31 to be described later to maintain the communication state.

In addition, when the drying communication module T2 receives a power command for supplying power to the drying control panel PA, the power may be controlled to be supplied to the drying control panel PA.

The mini apparatus 60 may include a mini control panel PC configured to display information and to receive a command from the user.

The mini control panel PC may include a mini displaying portion P8C capable of displaying the state of the mini apparatus 60, a mini input means P9C capable of inputting the command to the mini apparatus 60, and a mini speaker K3 capable of externally outputting a notification generated from the mini apparatus 60. The mini apparatus 60 may include a mini controller M3 that may perform the washing course and option of operating the driver, the water supply, the drainage, and the like of the mini apparatus 60, and may include mini storage S3 that transmits the information to the mini controller M3 or stores a program to be used by the mini controller M3.

The mini input means P9C may be a concept including all components configured to receive the command of the user for the laundry washing apparatus 10, such as the manipulation portion P47C, the power switch P46C, the executing portion P4C, the setting portion P2C, and the like to be described later.

In addition, the mini apparatus 60 may include a mini communication module T3. The mini communication module T3 may include a mini communication modem T31 including means of communication such as the Wi-Fi or the Bluetooth, a mini communication controller T32 configured to control the mini communication modem, and mini communication storage T33 that may transmit the received information to the mini controller M3 or may store a program for controlling the mini communication controller T32 when power to the mini controller M3 is cut off.

The mini communication module T3 may be configured to continuously receive the power even in a state in which power supply to the mini control panel PC of the mini apparatus 60 is cut off, and may be configured to maintain a state in communication with the external terminal 40 and the server 50.

In addition, the mini communication module T3 may be configured to be directly paired with the communication module T1 and the drying communication module T2 to be described later to maintain the communication state.

In addition, when the mini communication module T3 receives a power command for supplying power to the mini control panel PC, the power may be controlled to be supplied to the mini control panel PC.

In one example, the external terminal 40 may include a short-range communication module 40*b* configured to be in direct communication with the laundry washing apparatus 10, the laundry drying apparatus 20, and the mini apparatus 60, and a long-range communication module 40*a* configured to be in communication with the server 50.

In addition, the external terminal 40 may further include a terminal displaying portion 42 for displaying the information received from the communication module, a terminal input means 44 that transmits the command to a home appliance such as the laundry washing apparatus 10 or to the server 50, and a terminal controller 46 for controlling the terminal displaying portion 42, the terminal input means 44, and the communication module. The external terminal 40 may further include terminal storage 48 to store the information received from the communication module or to store a program for controlling the terminal controller 46.

The server 50 may include a communication device T5 capable of being in communication with the external terminal 40, the laundry washing apparatus 10, the laundry drying apparatus 20, and the mini apparatus 60, an arithmetic processor 52 that calculates information received from or to be transmitted to the external terminal 40, the laundry washing apparatus 10, the laundry drying apparatus 20, and the mini apparatus 60, and a storage device 54 in which the information received from the external terminal 40, the laundry washing apparatus 10, the laundry drying apparatus 20, and the mini apparatus 60 may be stored or the arbitrary course or option that may operate the laundry washing apparatus 10, the laundry drying apparatus 20, and the mini apparatus 60 may be stored.

FIG. 7 shows an embodiment of the control panel P that may be applied to the laundry treating apparatus of the present disclosure.

Hereinafter, a description will be made based on the control panel P being disposed in the laundry washing apparatus 10, but the control panel P may be applied to the laundry washing apparatus 10 and the laundry drying apparatus 20 with the same structure and may also be applied to the mini apparatus 60.

In other words, the control panel P, the drying control panel PA, and the mini control panel PC may have the same structure.

The laundry washing apparatus 10 includes the cabinet 1 and the control panel P disposed on the cabinet 1.

The control panel P refers to a device that enables communication between the user and the laundry treating apparatus (including other electronic devices in addition to the laundry treating apparatus). The communication between the user and the laundry treating apparatus means a process in which the user inputs the control command to the laundry treating apparatus and a process in which the laundry treating apparatus transmits the information to the user.

The user may input, via the control panel P, at least one of a power command of supplying or cutting off the power of the laundry treating apparatus, a selection command of selecting the arbitrary course or option that treats the laundry, an execution command of performing the selected course or option, and a stop command of stopping the course or option being performed.

The treatment of the laundry may include the washing cycle of removing the foreign substances of the laundry via water and the detergent, or a drying cycle of drying water contained in the laundry.

The control panel P may display an operation state of the laundry treating apparatus or information of the course or option to the user.

For example, the control panel P may display a state in which at least one of the power command, the selection command, the execution command, the performance command, and the stop command is input. In addition, the control panel P may display error information of displaying a problem situation occurring in the laundry treating apparatus, or guide information of guiding an action to be taken by the user.

The cabinet 1 may include the front panel 11 forming a front face of the cabinet 1, and the top panel 13 coupled to a top face of the front panel 11. The front panel 11 and the top panel 13 may be made of a metal material, and may have a steel plate shape.

The control panel P of the laundry treating apparatus of the present disclosure may be coupled to the front panel 11.

The control panel P may be coupled to a rear face of the front panel 11 and may be partially exposed to a front face of the front panel 11. The front panel 11 may be manufactured as a simple metal plate, and the control panel P may be simply coupled to the rear face of the front panel 11 and be fixed.

Accordingly, the front panel 11 may form a most area of the front face of the cabinet 1. As a result, a sense of unity of the front panel 11 may be strengthened and an aesthetics sensation may be maximized. In addition, a process of manufacturing the front panel 11 may be simplified, and a process of assembling or installing the front panel 11 and the control panel P may be simplified. In addition, a separate component such as a frame for mounting the control panel P on the front panel 11 may be omitted.

The control panel P of the laundry treating apparatus of the present disclosure may include a manipulation portion P7 rotatably coupled to the cabinet, and a displaying portion P8 disposed inside the manipulation portion P7 to display the state of the laundry treating apparatus.

The manipulation portion P7 may be formed in a shape of a rotary knob, and the displaying portion P8 may be formed as a display D including a liquid crystal or the like. It may be seen that the displaying portion P8 and a selection portion R to be described later are included in the manipulation portion P7.

The displaying portion P8 may be entirely formed as a touch panel, or may be at least partially formed as the touch panel.

The manipulation portion P7 may be configured to rotate to select the arbitrary course or option that may treat the laundry, and the displaying portion P8 may be configured to display a corresponding course or option each time the manipulation portion P7 rotates.

As a result, the control panel P of the laundry treating apparatus of the present disclosure may prevent an arbitrary course or option capable of rotating the drum to be described later from being displayed as characters, guide phrases, and the like in a certain area.

Accordingly, an area or an area ratio occupied by the control panel P in the front panel 11 may be greatly reduced, and the aesthetics sensation may be maximized as no separate characters or guide phrases are attached to the front panel 11.

A display P84 of the displaying portion P8 may include a state display area D1 for displaying the state of the laundry treating apparatus, and a content display area D2 for displaying the state in which the at least one of the power command, the selection command, the execution command, the performance command, and the stop command of the laundry treating apparatus is input, the error information, or the guide information of guiding the action to be taken by the user (see FIG. 11).

The state display area D1 may display a lock state D11 illustrating whether the door 132 is locked to the cabinet, an activation state D12 of the communication module T1, a executed state D13 of the course or the option, and a notification state D14 indicating that there is the notification information for the user.

The content display area D2, as an area displayed with the largest area in the displaying portion P8, may display the selected state, the executed state, the stop state, and the completion state of the course or the option, and may also display states of other home appliances to be described later.

In addition, the control panel P may further include the selection portion R for the user to input a determination command of determining the information to be displayed on the displaying portion P8. The selection portion R may be disposed inside the manipulation portion P7 to further reduce an area occupied by the control panel P.

The selection portion R may be disposed inside the displaying portion P8 and may be disposed spaced apart from the content display area D2. The selection portion R may be formed as a physical button or a touch panel for sensing a contact of a user's body.

The display P84 of the displaying portion may include an input area D3 that may request an input of the selection portion R at a point corresponding to the selection portion R. (see FIG. 11).

The input area D3 may be configured to emit light when the selection portion R may be activated to receive the command from the user.

In one example, the manipulation portion P7 and the displaying portion P8 may be operated only when the power is supplied.

To this end, the control panel P of the laundry treating apparatus of the present disclosure may further include the power switch P46 for inputting the power command to the laundry treating apparatus, as well as the manipulation portion P7 and the displaying portion.

The user may activate the manipulation portion P7 by inputting the power switch P46.

The front panel 11 may include a power switch mounting portion 116 formed such that the power switch P46 may be installed.

In addition, the control panel P may further include the executing portion P47 to which the performance command of performing or stopping the selected course or option is input.

The executing portion P47 may be formed separately from the manipulation portion P7 and the displaying portion P8 to reflect a definite performance or stop intention of the user. In addition, the functions of the manipulation portion P7 and the displaying portion P8 may be prevented from being excessive.

The front panel 11 may include an executing portion mounting portion 117 formed such that the executing portion P47 may be installed.

The control panel P may include one control box or casing P41 that may accommodate or install the power switch P46, the execution device P47, the manipulation portion P7, and the displaying portion P8 therein (see FIG. 9).

In one example, the control panel P may further include the setting portion P2 that may add an option to the course or change the option of the course on the front panel 11. The user may set an option capable of changing an intensity, a duration, and the like of the course via the setting portion P2.

The setting portion P2 may be formed separately from the casing P41 and may be coupled to the front panel 11. The setting portion P2 may include a separate liquid crystal and may include a touch panel or a physical button to input the option.

The power switch P46, the executing portion P47, the manipulation portion P7, and the setting portion P2 may be collectively referred to as the input means P9.

In one example, the front panel 11 may have the laundry inlet 111 defined to be in communication with the drum 2, and the door 132 that is pivotably coupled to the cabinet to open and close the laundry inlet 111.

The control panel P may be located above the door 132 to enhance accessibility of the user.

In one example, the front panel 11 may further include locking means L for fixing the door 132 to the front panel 11. When the laundry treating apparatus operates, such as the drum of the laundry treating apparatus rotates, the locking means L may lock the door 132 to the front panel 11. Therefore, a safety accident may be prevented. The locking means L may be unlock the door 132 when the operation of the laundry treating apparatus is completed.

The locking means L may be formed as any component as long as it is able to fix the door 132 to the cabinet 1. The locking means L may be formed as a fastener for fastening a hook protruding from the door, or may be formed as a solenoid valve for holding the hook.

The laundry treating apparatus of the present disclosure may include a detergent box 243 that accommodates therein the detergent for washing the laundry, and the front panel 11 may include a detergent hole P24 from which the detergent box 243 is extended.

The control panel P may be coupled to the front panel 11. As a result, the control panel P may include the input means P9 that receives the control command from the user, and the displaying portion P8 that outputs the information such as the control command selectable by the user.

The main controller M1 for controlling a command for performing the drying operation of the laundry treating apparatus may be installed.

The input means P9 may include a power supply requesting device P46 for requesting the power supply to the laundry treating apparatus, the manipulation portion P7 that enables the user to select a desired course among multiple courses, and the executing portion P47 for requesting start of the course selected by the user.

The displaying portion P8 may include at least one of a display panel capable of outputting text and figures, and a speaker capable of outputting a voice signal and sound. FIG. 8 shows a structure in which a control panel is coupled to a front panel.

As shown in the drawing, the laundry washing apparatus 10 may further include a detergent supply P24. The detergent supply P24 may include a detergent box housing 241 disposed inside the cabinet 1, a connecting pipe 242 for connecting the detergent box housing to the tub body 21, and a detergent box 243 that may be extended from the detergent box housing 241 through a detergent box laundry inlet 133 defined in the front panel 11.

The detergent box 243 may include a chamber 245 that provides a space in which the detergent is stored, and a discharge flow path 247 that discharges the detergent inside the chamber to the detergent box housing 241. The discharge flow path 247 may be formed as a water trap (a siphon flow path or the like) that allows liquid to flow to the detergent box housing 241 when a level of the liquid stored in the chamber 245 exceeds a preset water level.

When the detergent supply P24 is disposed in the laundry treating apparatus 10, the water supply 23 may further include a nozzle 232 for supplying water to the chamber 245. The nozzle 232 may be fixed to the cabinet 1 to form a top face of the detergent box housing 241, and the water supply pipe 231 may connect the nozzle 232 and the water supply source to each other.

A detergent box panel 248 may be disposed on a front face of the detergent box 243. The detergent box panel 248 may be formed in a shape to close the detergent box laundry inlet 133, and the detergent box panel 248 may have a detergent box handle.

The front panel 11 may be fixed to the cabinet 1 via a panel support 12. That is, the panel support 12 may be fixed to the cabinet 1, and the front panel 11 may be fixed to the panel support 12. The panel support 12 may have a detergent box through-hole 121 through which the detergent box 243 passes.

The control panel P may be fixed to the cabinet 1 via the panel support 12. The panel support 12 may have an interface mounting groove into which the control panel P is fixed.

The front panel 11 has a first button mounting portion 116 and a second button mounting portion 117. The first button 461 may be exposed to the outside of the cabinet 1 via the first button mounting portion 136, and the second button 471 may be exposed to the outside of the cabinet 1 via the second button mounting portion 117.

The first input means 46 and the second input means 47 may be separately disposed in a left space and a right space of the displaying portion P8, may be separately disposed in an upper space and a lower space of the displaying portion, or may be disposed vertically or horizontally in one of the left space and the right space of the displaying portion.

The cabinet 1 has a panel through-hole 134 defined to extend through the front panel 11. The shaft 71 may be inserted into the panel through-hole 134.

When the laundry treating apparatus is formed as the laundry drying apparatus 20, the rest may be the same except that the component related to the detergent box is changed to the water storage 7.

FIG. 9 shows an internal structure of a control panel.

The control panel P includes a circuit board (a first circuit board) P4 fixed to the panel support 12 and positioned inside the cabinet 1, an encoder P5 fixed to the circuit board and located inside the cabinet 1, the manipulation portion P7 connected to the encoder P5 through the front panel 11, and the displaying portion P8 fixed to the encoder P5 or the first circuit board P4 through the front panel 11.

The first circuit board P4, as a board equipped with a control circuit required for control (power control and operation control) of at least one of the drivers 32, a steam apparatus 200, and the water supply portion 23, the discharge portion 25 may be fixed to the panel support 12 via the casing P41. The casing P41 may have any shape as long as it is able to fix the first circuit board 4 to the panel support 12.

The casing P41 may be formed in a hexahedral shape with one face (a face facing the panel support) open.

A boss for setting a position of the first circuit board P4 may be disposed in the casing P41. The boss may include a first boss 411 and a second boss 412.

In this case, the first circuit board P4 may have a board through-hole P42 through which the first boss 411 passes, and a boss insertion hole P43 through which the second boss 412 passes. The second boss 412 may be disposed in each of left and right spaces of the first boss 411, or may be disposed in each of upper and lower spaces of the first boss 411.

A wire 822 is connected to the displaying portion P8. The wire 822 may be formed as a power line for supplying the power to the displaying portion, or may be formed as a communication line that enables the displaying portion P8 to communicate with devices inside the cabinet including the first circuit board P4.

The first boss 411 may have a first boss through-hole 413 defined therein, and the panel support 12 may have a wire through-hole P42 (see FIG. 4) defined therein. In this case, the wire 822 may be extended into the cabinet 1 by being inserted into the first boss through-hole 413 and the wire through-hole P42.

The first circuit board P4 may further include the power switch P46 and the executing portion P47. The laundry device P46 may be formed as means for inputting the control command for requesting the power supply to the laundry treating apparatus 100, and the executing portion P47 may be formed as means for inputting a command for requesting execution of the control command displayed on the displaying portion P8 or a command for temporarily stopping the control command being executed by the laundry treating apparatus 10.

The power switch P46 and the executing portion P47 may be configured to generate a control signal by sensing static electricity of the user's body.

The power switch P46 may include the first button 461 exposed to the outside of the cabinet 1, a first detection sensor 469 fixed to the first circuit board P4, and a conductor (a first touch spring) 463 for connecting the first button and the first detection sensor to each other. Similarly, the executing portion P47 may include the second button 471 exposed to the outside of the cabinet 1, a second detection sensor 474 fixed to the first circuit board P4, and a conductor (a second touch spring) (not shown) for connecting the second button and the second detection sensor to each other.

The front panel 11 has the first button mounting portion 136 and the second button mounting portion 117. The first button 461 may be exposed to the outside of the cabinet 1 via the first button mounting portion 116, and the second button 471 may be exposed to the outside of the cabinet 1 via the second button mounting portion 117.

The power switch P46 and the executing portion P47 may be separately disposed in the left space and the right space of the displaying portion P8, may be separately disposed in the upper space and the lower space of the displaying portion, or may be disposed vertically or horizontally in one of the left space and the right space of the displaying portion.

The first touch spring 463 and the second touch spring may be formed in a shape of a coil, which is to provide a restoring force to the first button 461 and the second button 471. Furthermore, in order to prevent the first button 461 and the second button 471 from being respectively deviated from the button mounting portions 116 and 117, the power switch 46 may have a first stopper 462 that limits a range of motion of the first button, and the execution device 47 may have a second stopper (not shown) that limits a range of motion of the second button.

The encoder P5 is means for rotatably fixing the manipulation portion P7 to the first circuit board P4, and is means for generating an electrical signal (or generating an electrical signal set differently based on a rotation angle of an actuator) during the rotation of the manipulation portion P7.

The drying control panel PA may have the same structure as the control panel P.

In addition, the mini control panel PC may also have the same structure as the control panel P.

FIG. 10 shows a structure of an encoder.

The encoder P5 may include a fixed portion P51 fixed to the first circuit board P4 and to which the displaying portion P8 is fixed, a rotating portion P52 rotatably disposed on the fixed portion P51 and to which the manipulation portion P7 is fixed, and a signal generator P54 for generating an electrical signal when the rotating portion P52 is rotated.

The fixed portion P51 may include a fixed body P512 fixed to the first circuit board P4, a support body 511 extending from the fixed body 512 and rotatably fixing the rotating portion P52, and a body through-hole 514 connected to the board through-hole P42 (connected to the first boss through-hole) through the fixed body and the support body.

The fixed body 512 may be formed in a cylindrical shape. A board fastening portion 513 may be disposed on a circumferential face of the fixed body 512 or on one face (a face facing the first circuit board) of the fixed body. In this case, the first circuit board P4 may have an encoder fixing hole P44 defined therein into which the board fastening portion 513 is inserted.

The board fastening portion 513 and the encoder fixing hole P44 may respectively include multiple board fastening portions and multiple encoder fixing holes, and the encoder fixing holes P44 may be arranged to surround the board through-hole P42.

Inside the body through-hole 514, a fastening body fixing portion 531 for fastening the displaying portion P8 to the fixed portion 51, and a position setting groove 532 for preventing the displaying portion 8 from rotating (fixing the position of the displaying portion) when the displaying portion P8 is inserted into the body through-hole 514 may be disposed.

The fastening body fixed portion 531 may be formed as a protrusion protruding toward a center of the body through-hole 514 from at least one of the support body 511 and the fixed body 512. The drawing shows a case in which the fastening body fixed portion 531 is disposed on the support body 511 as an example.

The positioning groove 532 may be defined as a groove in which one face of the fixed portion P51 defining the body through-hole 514 is concavely bent. In this case, the positioning groove 532 may be defined along a longitudinal direction of the body through-hole 514.

The rotating portion P52 may be formed as a rotating body 521 rotatably coupled to the support body 511. The rotating body 521 should have a rotating body through-hole through which the support body 511 passes.

The rotating body 521 may have a shaft fastening portion 522 to which the manipulation portion P7 is fastened. The shaft fastening portion 522 may be formed as a fastening hole extending through a circumferential face of the rotating body 521, or may be formed as a fastening groove defined as the circumferential face of the rotating body 521 is concavely bent.

The signal generator P54 may include a magnet fixed to the rotating body 521, a sensor that is disposed on the fixed body 512 or the support body 511 to sense a magnetic force, and a terminal that connects the sensor and the first circuit board 4 to each other. The magnet may be formed as multiple permanent magnets are arranged to be spaced apart from each other along the circumferential face of the rotating body 521.

The first circuit board P4 to which the encoder P5 is assembled may be coated with an insulating material. This is to minimize a possibility that water is supplied to the first circuit board P4 and the circuit is short-circuited. When the insulating material is coated on one face (a face facing the front panel) of the first circuit board P4, in order to prevent the rotating body 521 from being fixed to the support body 511 by the insulating material, the control panel P may further include an encoder cover P6.

The encoder cover P6 may be formed in a pipe shape that is fixed to the first circuit board P4 and surrounds the encoder P5. That is, as shown in the drawing, the encoder cover P6 may include a fixed body cover P61 that is fixed to the first circuit board P4 and surrounds the fixed body 512, and a cover through-hole P62 defined to extend through the fixed body cover P61 and into which the encoder 5 is inserted.

The fixed body cover P61 may have a board fastening portion 611, and the first circuit board P4 may have an encoder cover fixing hole P45 to which the board fastening portion 611 is fixed. The board fastening portion 611 and the encoder cover fixing hole P45 may respectively include multiple board fastening portions and multiple encoder cover fixing holes, and the encoder cover fixing holes P45 may be arranged to surround the board fastening portion 513.

For discharging water introduced into the fixed body cover P61, a cover outlet 612 may be further disposed on a circumferential face of the fixed body cover P61. The cover outlet 612 is preferably located at a lowermost end of the circumferential face of the fixed body cover P61.

In one example, the above-described insulating material is applied to the first circuit board P4 after both the encoder P5 and the encoder cover P6 are coupled to the first circuit board P4, and the insulating material sprayed on a partial area of the first circuit board P4 (an outer space of the encoder cover) flows into the encoder cover P6 through the cover outlet 612. In such a process, in order to block the insulating material from being supplied to the rotating body 521, a distance L1 from the first circuit board to an uppermost end of the fixed body 512 is preferably set to be equal to or greater than a distance L2 from the first circuit board to an uppermost end of the cover outlet 612.

The encoder cover P6 may further include a support body cover P63 extending from the fixed body cover P61 and surrounding the rotating body 521 (surrounding the support body). The support body cover P63 may limit the movement of the manipulation portion P7 in a radial direction of the cover through-hole 62, so that the support body cover P63 may prevent the manipulation portion P7 from being separated from the rotating body 521.

FIG. 11 shows a structure of a manipulation portion and a displaying portion.

The manipulation portion P7 may include a shaft P71 that is fixed to the rotating body 521 through the front panel 11, and a handle P73 fixed to the shaft P71 and positioned outside the cabinet 1.

The cabinet 1 has the panel through-hole 134 defined to extend through the front panel 11. The shaft P71 may be disposed to be inserted into the panel through-hole 134.

The shaft P71 may be formed a pipe having a shaft through-hole 711 defined therein. The rotating body 521 disposed in the encoder is inserted into the shaft through-hole 711, and a rotating body fastening portion 712 disposed on a circumferential face of the shaft P71 and positioned inside the shaft through-hole 711 is coupled to a shaft fastening portion 522 disposed on the rotating body. Accordingly, the shaft P71 is fixed to the rotating body 521 via the rotating body fastening portion 712 and the shaft fastening portion 522.

The handle P73 may be fixed to the shaft P71 so as to be located outside of the cabinet 1, and the user may provide a force required for the rotation of the rotating body 521 to the shaft P71 via the handle P73.

The handle P73 may include an accommodation space 731 defined inside the handle to be in communication with the shaft through-hole 711, and a handle through-hole 732 that extends through one face of the handle P73 to allow the accommodation space 731 to be in communication with the outside.

When a diameter of the handle P73 is set to be larger than a diameter of the shaft P71, the shaft P71 may further include a base 713 to which the handle P73 is fixed. The base 713 may be formed as a disk fixed to the circumferential face of the shaft P71.

The handle P73 and the base 713 may be coupled to each other via a base fastening portion 734 disposed on the handle 73 and a handle fastening portion 714 disposed on the base 713.

The base fastening portion 734 may be formed as multiple protrusions fixed to the handle so as to be located inside the accommodation space 731, and the handle fastening portion 714 may be formed as a groove defined in the base 713 and accommodating the protrusion therein.

In order to facilitate the coupling of the handle P73 and the base 713, the handle P73 may have a fastening guide 735 positioned between one base fastening portion 734 and another base fastening portion 734, and the base 713 may have a guide groove 715 into which the fastening guide 735 is inserted. The guide groove 715 may be defined as a groove in which a circumferential face of the base 713 is bent toward the shaft through-hole 711.

The displaying portion P8 may include a housing P81 fixed to the fixed body 512 of the encoder and located inside the accommodation space 731 of the actuator, the display P84 fixed to the housing and displaying information (information related to control, operation, and the like of the laundry treating apparatus), and a circuit board (second circuit board and a displaying portion circuit board) P82 disposed in the housing and having a circuit for controlling the display P84.

The housing P81 may include a fastening body 81*b* fixed to the fixed body 512 by extending through the shaft through-hole 711 and being inserted into the body through-hole 514, and an accommodating body 81*a* fixed to the fastening body 81*b* and positioned inside the accommodation space 731.

The accommodating body 81*a* may be formed in any shape as long as it may be inserted into the accommodation space 731. A case in which the accommodating body 81*a* is formed in a cylindrical shape is shown as an example.

A mounting space 811 is defined inside the accommodating body 81*a*, and the mounting space 811 is in communication with the accommodation space 731 defined in the handle via an accommodating body through-hole 812 (the accommodating body through-hole is defined to be in communication with the handle through-hole). That is, the accommodating body through-hole 812 is defined in a face directed in a direction in which the handle through-hole 732 is located of the space provided by the accommodating body 81*a*.

The fastening body 81*b* may be formed in any shape as long as it is able to be inserted into the shaft through-hole 711 and the body through-hole 514 of the encoder. A case in which the fastening body 81*b* is formed in a cylindrical shape is shown as an example. The fastening body 81*b* has a fastening body through-hole 815 connected to the mounting space 811.

A fixed body fastening portion 816 may be disposed on a circumferential face of the fastening body 81*b*. The fixed body fastening portion 816 is means for fixing the housing P81 to the fastening body fixing portion 531 disposed in the encoder.

Further, multiple position setting protrusions 817 may be further disposed on the circumferential face of the fastening body 81*b*.

The position setting protrusion 817 is formed in a shape capable of being inserted into the position setting groove 532 defined in the encoder, and the position setting protrusion 817 is disposed at a point corresponding to a position of the position setting groove 532. The position setting protrusion 817 and the position setting groove 532 are means for minimizing a risk that the fixed body fastening portion 816 fails to be coupled to the portion 531 (means for ensuring the coupling of the fixed body fastening portion and the fastening body fixing portion) when the fastening body 81*b* is inserted into the body through-hole 514.

The second circuit board P82 may be inserted into the mounting space 811, and the wire 822 connected to the second circuit board P82 may be withdrawn to the outside of the housing P81 through the fastening body through-hole 815. Multiple lamps 821 may be disposed on the second circuit board P82.

The second circuit board P82 may control the display P84 to display preset information in response to an electrical signal generated from the signal generator 54 when the handle P73 is rotated.

In order to maintain a gap between the second circuit board P82 and the display P84 and to prevent damage to the lamp 821, a mounting portion P83 positioned between the display P84 and the second circuit board P82 may be disposed in the mounting space 811.

The mounting portion P83 may be formed as a mounting body 831 fixed to the accommodating body 81*a* and positioned inside the mounting space 811. The mounting body 831 may have any shape as long as it is able to be inserted into the mounting space 811.

A seating groove 832 to which the display P84 is fixed is defined in one face of the mounting body 831. The seating groove 832 may have a connector through-hole 836. A connector 841 (a flexible PCB or the like) disposed in the display P84 may be connected to the second circuit board P82 by being inserted into the connector through-hole 836.

The mounting body 831 may have a lamp through-hole 835 into which the lamp 821 is inserted. It is preferable that the number of lamp through-holes 835 is the same number as the number of the lamps 821, and a position of the lamp through-hole 835 should be set to a space of the mounting body located above the mounting groove 832 or a space of the mounting body located below the mounting groove 832. This is for light emitted from the lamp 821 to be transmitted to the outside of the housing P81 through the lamp through-hole 835.

The mounting portion P83 is fixed to the housing P81 via a mounting body fastening portion 813 disposed on the accommodating body 81*a* and an accommodating body fastening portion 833 disposed on the mounting body 831. The mounting body fastening portion 813 may be formed as multiple protrusions located inside the mounting space 811, and the accommodating body fastening portion 833 may be defined as a groove or the like defined in the circumferential face of the mounting body 831 (one face of the mounting body in contact with the accommodating body) and to which the mounting body fastening portion 813 is fixed.

The number of mounting body fastening portions 813 and the number of accommodating body fastening portions 833 should be set to be the same, and positions of the mounting body fastening portion 813 and the accommodating body fastening portion 833 should be set to correspond to each other.

In order to increase a fastening force of the mounting body 831, the accommodating body fastening portion 833 may include an upper fastening portion positioned higher than the seating surface 832 and a lower fastening portion positioned lower than the seating surface 832. Unlike the drawing, the accommodating body fastening portion 833 may be disposed on each of left and right sides of the seating face.

A window P85 may be further disposed on the accommodating body 81*a* to prevent water and foreign substances from flowing into the display P84 and the second circuit board P82.

Preferably, the window P85 is fixed to at least one of the accommodating body 81*a* and the mounting body 831 to close the accommodating body through-hole 812. The window P85 should be made of a material having a transparency that allows the information displayed on the display P84 and the light emitted from the lamp 821 to be viewed from the outside.

When the window P85 is fixed to the mounting body 831, the window P85 may have a cover fixing protrusion 851 protruding toward the mounting body 831, and the mounting body 831 may have a fixing protrusion fastening portion 834 to which the cover fixing protrusion 851 is coupled.

The second circuit board P82 may also be fixed to the mounting body 831. That is, the mounting portion P83 may have a protrusion protruding from the mounting body 831 toward the second circuit board 82, and the second circuit board 82 may have a protrusion through-hole 823 into which the protrusion is inserted.

Further, the window P85 may further include a cover sheet 853 for lowering the transparency of the cover. It is preferable that a transparency of the cover sheet is set to such a degree that it is difficult to view the interior of the mounting space 811 from the outside (the transparency of the cover sheet is set lower than the transparency of the cover). The cover sheet 853 may be fixed to a surface of the window P85, and a letter or symbol H may be displayed in an area of the cover sheet on which the lamp through-hole 835 is projected.

In one example, a lamp through-hole 835 corresponding to the input area D3 among the lamp through-holes 835 in the mounting portion P83 may provide a signal instructing the user to press the input area D3.

The selection portion R may be disposed inside the displaying portion P8. Specifically, the selection portion R may be formed as a component of the displaying portion P8 and may be disposed in the displaying portion P8 to be disposed inside the manipulation portion P7.

Accordingly, it may be seen that the displaying portion P8 includes the selection portion R that receives a determination command to determine the state information displayed on the display P84. Because the determination command determined by the selection portion R changes based on the state information, the selection portion R may correspond to a variable input means.

For example, when the selection information of the course and the option is displayed on the display P84, the selection portion R may be configured to input a determination command to select or determine the course and option. In addition, when a guide is displayed on the display P84, the selection portion R may be configured to input a determination command to identify the guide.

As a result, the selection portion R may be configured to, based on a type of the control command displayed on the display 84, receive a determination command for the user to identify or determine the corresponding control command.

The selection portion R may be configured to determine whether the control command displayed on the display P84 is selected by sensing whether the user's body is in contact with the window P85.

That is, the selection portion R may include a sensor R3 disposed on the second circuit board 82 and sensing the static electricity of the user's body, and a conductor R2 or a physical button R1 for connecting the sensor R3 and the window P85 to each other.

The selection portion R may be composed of a receiver R1 attached to or coupled to the window P85, and a transmitter R2 having one end connected to the receiver R1 and the other end connected to the sensor R3. In this case, the mounting body 831 must have a conductor through-hole 837 into which the transmitter R2 is inserted.

The receiver R1 is means for facilitating the input of the control command by expanding an area that the user may contact. In the control panel P having the above structure, the display area D1 is formed in an upper space of the window P85, and the input area D3 is formed in a lower space of the window P85. Therefore, when a width of the receiver R1 is set to be great, a width of the input area D3 is expanded, so that the user may more easily input the control command. The width of the receiver R1 is preferably set to equal to or smaller than ¼ to ½ of a width of the window P85.

The transmitter R2 and the receiver R1 may be formed as a conductor. Therefore, when the user's body is in contact with the transmitter R2 and the receiver R1, a current of the user's body may be charged or transmitted, so that the current may be transmitted to the sensor R3.

In addition, the transmitter R2 and the receiver R1 may be formed physical buttons. Therefore, when the user's body presses the receiver R1, the pressure of the body may be transmitted to the sensor R3.

The receiver R1 may be formed as a film that is printed or attached to a rear face of the window P85, and may be made of a carbon-based material or the like.

In one example, the displaying portion P8 may include inducing means 839 for inducing the user to press the selection portion R.

The inducing means 839 may guide the user to the location of the selection portion R to induce the user to press the selection portion R.

The inducing means 839 may include the lamp 821 and the lamp through-hole 835 corresponding to the position of the receiver R1. Specifically, the inducing means 839 may include the lamp through-hole 835 defined below the display P84 and the lamp 821 installed inside the lamp through-hole 835.

The lamp through-hole 835 and the lamp 821 constituting the inducting means 839 may be disposed below the display P84 and at a center of the mounting portion 83.

Accordingly, when the lamp 821 emits the light in the inducting means 839, the selection portion R or an area adjacent to the selection portion R may be brightened.

In addition, the lamp 821 of the inducing means 830 may be formed as an LED element and the like to indicate a separate character or phrase.

The control panel P having the above structure enables display of the control command, search for the displayed control command, and selection of the displayed control command, and enables minimization of a space required for installation. However, the control panel P having the above structure needs means to block the inflow of water or the foreign substances to the displaying portion P8 and the manipulation portion P7 or to discharge the inflowed water or foreign substances to the outside.

The control panel P having the above structure will display a preset control command on the display P84 whenever the user rotates the handle P73 (whenever the encoder generates the electrical signal) (search and change the control command).

When the desired control command is displayed on the display P84, the user may select the displayed control command via the selection portion R, and the control command selected via the selection portion R may be initiated when the user inputs an execution command via the executing portion P47.

In one example, the handle P73 is coupled to the first circuit board P4 to enable a rotational movement, whereas the housing P81 of the displaying portion is fixed to the first circuit board P4, so that it is necessary to keep a gap between the handle P73 and the housing P81 constant. This is because, when the gap between the handle P73 and the housing P81 is not maintained, the rotation of the handle 7P3 is likely to be constrained.

FIG. 12 shows a detailed configuration of the manipulation portion P7.

The shaft P71 may be coupled to the encoder to rotate the encoder. The base P713 may extend from a distal end of the shaft to have a larger diameter than the shaft. The handle P75 may be coupled to the base to rotate the shaft and the encoder.

A diameter of the base 713 may be larger than a diameter of the panel through-hole. The base 713 may extend from the distal end of the shaft to face the panel through-hole.

The handle P73 may be coupled to an outer circumferential face of the base P713, and a diameter of the handle P75 may be greater than a width of the panel through-hole.

A diameter of the encoder P5 may be smaller than the width of the panel through-hole.

An outer circumferential face of the manipulation portion P7 may have a larger diameter than an outer circumferential face of the encoder P5.

The shaft P71 may be formed as a pipe having a shaft through-hole 711 defined therein. The rotating body 521 disposed in the encoder is inserted into the shaft through-hole 711, and the rotating body fastening portion 712 disposed on a circumferential face of the shaft P71 and located inside the shaft through-hole 711 is coupled to the shaft fastening portion 522 disposed in the rotating body. Accordingly, the shaft P71 is fixed to the rotating body 521 via the rotating body fastening portion 712 and the shaft fastening portion 522.

The handle P73 may be fixed to the shaft P71 so as to be located outside the cabinet 1, and the user may supply a force required for rotation of the rotating body 521 to the shaft P71 via the handle P73.

The handle 7P3 may include an accommodation space 731 defined inside the handle to be in communication with the shaft through-hole 711, and a handle through-hole 732 that extends through one face of the handle 73 to communicate the accommodation space 731 with the outside.

When a diameter of the handle P73 is set to be larger than a diameter of the shaft P71, the shaft 71 may further include a base 713 to which the handle P73 is fixed. The base 713 may be formed as a disk fixed to a circumferential face of the shaft P71.

The handle P73 and the base 713 may be coupled to each other via a base fastening portion 734 disposed in the handle 73 and a handle fastening portion 714 disposed in the base 713.

The interface P having the above-described structure enables the display of the control command, the search for the displayed control command, and the selection of the displayed control command, and minimizes the space required for the installation. However, the interface P of the above-described structure requires means for blocking the inflow of water or the foreign substances to the display portion P8 and the manipulation portion P7 or for discharging the introduced water or foreign substances to the outside.

The manipulation portion P7 may have means for discharging the water or the foreign substances flowed into the handle through-hole 732 to the outside of the accommodation space 731, and the display portion P8 may have means for blocking the inflow of the foreign substances (external air, liquid, dust, and the like) into the housing 81.

As described above, the manipulation portion P7 may discharge the water or the foreign substances introduced into the accommodation space 731 through the handle outlet P74 defined in the handle to the outside of the accommodation space.

FIG. 13 shows an embodiment of a sealing member.

In one example, the display portion P8 may have sealing portions C and P75 that block the foreign substances from entering the housing. That is, the display portion P8 may have a second sealing member 75 that blocks the foreign substances from being introduced through the fastening portion through-hole 815, and a first sealing member C that blocks the foreign substances from being introduced through the accommodating body through-hole 812.

Although the drawing shows a case in which both the second sealing member 75 and the first sealing member C are disposed, the sealing portion may include only one of the second sealing member 75 and the first sealing member C.

The first sealing member C may be made of an adhesive material for filling a space between the window P85 and the accommodating body 812 and fixing the window P85 to the accommodating body 812 by being sprayed onto the accommodating body 81*a* along an edge of the window P85.

The second sealing member 75 may be inserted into the fastening portion through-hole 815 not only to fix a position of the wire 822, but also block the foreign substances from flowing into the fastening portion through-hole 815.

FIG. 13 shows an example of the second sealing member 75. The second sealing member 75 in FIG. 13 may include a sealing body 751 inserted into the fastening portion through-hole 815, a sealing body through-hole 752 defined to extend through the sealing body 751 and into which the wire 822 is inserted, and cut-out portions 753, 754, and 755 defined as a circumferential face of the sealing body 751 is cut and connecting the circumferential face of the sealing body 751 and the sealing body through-hole 752 to each other.

The sealing body 751 may be formed in any shape as long as it is able to be inserted into the fastening portion through-hole 815.

FIG. 14 shows a case in which the sealing body 751 is formed in a cylindrical shape as an example.

A diameter of the sealing body 751 may be set larger than a diameter of the fastening portion through-hole 815. In this case, it is preferable that a material of the sealing body 751 is set to rubber or silicone having a relatively great elastic force such that the fastening portion through-hole 815 may be closed through an interference fit.

The cut-out portions may include a first cut-out face 753 that faces a center of the sealing body through-hole 752 from the circumferential face of the sealing body 751, a second cut-out face 754 that faces the center of the sealing body through-hole 752 from the circumferential face of the sealing body 751 and spaced apart from the first cut-out face 753, and a cut-out groove 755 defined between the first cut-out face 753 and the second cut-out face 754. The wire 822 may be inserted into the sealing body through-hole 752 through the cut-out groove 755 or may be withdrawn from the sealing body through-hole 752.

A gap between the first cut-out face 753 and the second cut-out face 754 is preferably set to a length with which the two cut-out faces 753 and 754 come into contact with each other to close the cut-out groove 755 when the sealing body 751 is inserted into the fastening portion through-hole 815.

In order to more reliably block the foreign substances from entering the space defined between the circumferential face of the sealing body 751 and the fastening portion through-hole 815, the circumferential face of the sealing body 751 may further include a first contact protrusion 756.

The first contact protrusion 756 may be formed as a belt-shaped protrusion extending from the first cut-out face 753 to the second cut-out face 754 along the circumferential face of the sealing body 751. The first contact protrusion 756 may be formed as multiple band-shaped protrusions are arranged to be spaced apart from each other along a height direction of the sealing body 751.

In order to prevent the foreign substances from being introduced into the cut-out groove 755, the sealing body 751 may further include a second contact protrusion 757. The second contact protrusion 757 may be formed to protrude from at least one of the first cut-out face 753 and the second cut-out face 754 toward the other.

Furthermore, the second contact protrusion 757 may be constructed to connect the first contact protrusion 756 and the sealing body through-hole 752 to each other, and may be constructed to connect the sealing body through-hole 752 with a point 7561 located between the two first contact protrusions 756.

In addition, in order to prevent the foreign substances from being introduced into the space between the wire 822 and the sealing body through-hole 752, a third contact protrusion 758 may be further disposed in the sealing body through-hole 752. This is because a possibility that the foreign substances are introduced through the sealing body through-hole 752 cannot be excluded even when a diameter of the sealing body through-hole 752 (a diameter in the state in which the sealing body is inserted into the fastening portion through-hole) is set smaller than a diameter of the wire 822.

The third contact protrusion 758 may be formed as a belt-shaped protrusion protruding toward a center of the sealing body through-hole 752 from a face of the sealing body 751 defining the sealing body through-hole 752. The third contact protrusion 758 may extend from the first cut-out face 753 to the second cut-out face 754, and may be connected to the second contact protrusion 757.

FIG. 14 shows utilization of the control panel.

In the state display area D1 of the displaying portion P8, whether the door is locked, whether the communication module is activated, whether the course or the option is operated, whether the guide phrase is generated, and the like may appear in a form of an icon.

In addition, the number of displayed contents that may appear while rotating the manipulation portion P7 may be displayed in the state display area D1. For example, a plurality of dots may be arranged to be spaced apart from each other, and the number of contents displayed in the content display area D2 may be provided while one of the plurality of dots emits the light.

In the content display area D2, contents of the course and the option, the executed state of the course or the option, and the guide phrase necessary for the user may be displayed. The content display area D2 may be larger than the state display area D1.

In the input area D3, light may be emitted to request the input of the user, and the guide phrase indicating which content the user should input may be displayed.

The power switch P46 may be disposed at a left side of the displaying portion P8, and the executing portion P47 may be disposed at a right side of the displaying portion P8.

The manipulation portion P7 may be rotatably disposed on an outer circumferential face of the displaying portion P8, and may rotate the drum 3.

The arbitrary course may be a series of control methods for performing the washing cycle (the drying cycle) of washing the laundry.

When the manipulation portion P7 is rotated, a name of the corresponding course and a simple option name may be displayed in the content display area D2 of the displaying portion P8 based on a set order, and a description of the course or the option may be displayed.

The option may be selected by the setting portion P2. The setting portion P2 may be configured to receive a selection command for selecting at least one of the arbitrary options. The arbitrary option may include setting additional conditions of the course.

For example, the arbitrary option may be a set algorithm or a control method for adjusting at least one of the number of repetitions of each cycle to perform the course, an intensity of performing each cycle, a rotation speed of the drum when performing each cycle, a temperature of water, an amount of water, and a duration of each cycle.

The setting portion P2 may be formed as a touch display for selecting the arbitrary option, and may have a plurality of lamps and a plurality of conductor switches capable of sensing the user's body.

For example, the setting portion P2 may include option selection portion B that receives a setting command to set the conditions for the course, and option displaying portion B4 that displays option information corresponding to the option selection portion B.

For example, the option selection portion B may include rinsing means B1 for adjusting a rinsing force related to the rotation speed and duration of the drum, the amount of water, and the number of times of rinsing when the course performs the rinsing cycle, dehydration means B2 for adjusting a dehydration force related to the rotation speed and duration of the drum when the course performs the dehydration cycle, and temperature means B3 of adjusting a temperature of water when the course performs the washing cycle.

The option displaying portion B4 may be configured to indicate the rinsing force, the dehydration force, and the temperature in an objectified and unitized manner.

In one example, the setting portion P2 may have a utilizing means C that receives a utilization command to utilize a function of the laundry treating apparatus.

For example, the utilizing means C may include washing means C1 for inputting a special washing cycle such as functional laundry washing, soft laundry washing, and tub washing, reservation means C2 for inputting a reservation command to perform the washing course at a specific time, sterilizing means C for promoting sterilization by adding steam to the laundry during the course cycle, and additional function means C4 for utilizing additional functions such as pairing with other devices.

In addition, the setting portion P2 may include switching portion E for receiving a connection command to be in communication with the laundry drying apparatus 20 or the mini apparatus 60.

In one example, the setting portion P2 allows a function that may be utilized at a present time point or a function selected by the user to be turned on and allows a function that is not able to be executed or is not selected by the user to be turned off.

The setting portion P2 may display all of the contents via an auxiliary display P19.

Hereinafter, an embodiment and a control method for displaying and controlling the laundry drying apparatus 20 or the mini apparatus 60 with the control panel P of the laundry washing apparatus 10 will be described. However, this is only for omitting repetitive descriptions, and is able to be equally applied when controlling the laundry washing apparatus 10 or the mini apparatus 60 with the drying control panel PA.

In addition, the same may be applied when controlling the laundry washing apparatus 10 or the laundry drying apparatus 20 with the mini control panel PC.

FIG. 15 shows a structure of the display portion P8 accommodated inside the manipulation portion.

Referring to (a) in FIG. 15, the display portion P8 has a mounting portion P83 inside the housing P81, and the window P85 is coupled to the mounting portion P83 from the front. Because the housing P81 is accommodated inside the rotating manipulation portion P7, the housing P81 may have a circular cross-section for rotation of the manipulation portion P7.

The housing P81 may include an accommodating body 81*a* for accommodating the mounting portion P83 therein, and a fastening portion 81*b* extending from the accommodating body and coupled to the encoder.

The display P84 displaying information received from the control panel P may be seated in the mounting portion P83, and the circuit board P82 controlling the entire display portion P8 may also be accommodated in the mounting portion P83.

In one example, the window P85 may be disposed in front of the mounting portion P83 to block the mounting portion P83 and the display P84 from being exposed to the outside. An external impact or the foreign substances generated or transmitted from the front face of the control panel P may be prevented from being transmitted to the display P84 or the circuit board P82.

The window P85 may be made of a glass material such as glass, or may be made of a reinforced plastic having transparency. The window P85 may be charged with a current generated in the user's body, or may have a thickness such that the current generated in the user's body may be sufficiently transmitted in a thickness direction.

The window P85 may be fixedly coupled to an inner circumferential face of the accommodating body 81*a*.

In one example, the housing P81 may have a gap 81*c* between an outer circumferential face of the window P85 and the inner circumferential face of the accommodating body 81*a*. In order to easily seat the window 85 on the accommodating body 81*a*, the window 85 may be designed to have a diameter the same as or smaller than that of the accommodating body 81*a*.

As a result, the gap 81*c* may always exist between the window P85 and the accommodating body 81*a*.

Referring to (b) in FIG. 15, when the gap 81*c* is always present between the window P85 and the accommodating body 81*a*, there is a risk that the window P85 may be deviated from the accommodating body 81*a*.

In addition, due to the gap 81*c*, moisture or the like discharged from the laundry may be introduced into the gap 81*c* and may damage the circuit board P82.

In one example, the diameter of the window P85 may be larger than that of the accommodating body 81*a* to resolve the gap 81*c*. However, when the window P85 is forcibly fitted to the accommodating body 81*a*, the diameter of the accommodating body 81*a* may be changed and the rotation of the manipulation portion P7 may be restricted. In addition, the gap 81*c* may also exist between the window P85 and the accommodating body 81*a* due to an existence of a tolerance.

FIG. 16 shows an embodiment of removing a gap of the display portion P8 of the present disclosure.

Referring to (a) in FIG. 16, the display portion P8 may include the first sealing member C disposed between the inner circumferential face of the housing P81 and the outer circumferential face of the window P85 to block the inflow of the foreign substances into the housing P81.

The first sealing member C may be disposed to be inserted into the gap 81*a*. The first sealing member C may be disposed to be inserted into the gap 81*a* by being formed as a rubber packing or the like having elasticity. However, when the first sealing member C is formed as a separate additional component such as a sealing member, there may be inconvenience in that an additional process of assembling the display portion P must be further performed. In addition, there may be an assembling tolerance for assembling the first sealing member C, so that the gap 81*c* may occur again.

Therefore, the first sealing member C may be made of a fixing material such as an adhesive that is made of a liquid with very high viscosity but hardens over time. Accordingly, the first sealing member C may not only fill the entire gap 81*c* regardless of a shape and a thickness of the gap 81*c*, but also fix the window P85 to the housing P81 during a hardening process.

Accordingly, the gap 81*c* itself disappears, so that water and the moisture may be fundamentally blocked from being introduced between the window P85 and the housing P81.

FIG. 17 shows a structure of the display portion P8 of the present disclosure.

The first sealing member C may be formed as a material embedded in the gap C between the inner circumferential face of the housing P81 and the outer circumferential face of the window P85.

When the first sealing member C is embedded in the gap 81*c* and fixed, a frictional force is generated with the window P85 in a thickness direction and an adhesive force is generated in a radial direction of the window, so that the window P85 may be prevented from being deviated from the accommodating body 81*a*.

In addition, because the first sealing member C has its own viscosity, when vibration is transmitted to the display portion P8, the first sealing member C may buffer the vibration at a certain level. Accordingly, durability of the window P85 may also be ensured.

In one example, the housing P81 may further include a mounting rib 81*c* that defines a mounting space in which the first sealing member C is accommodated on the inner circumferential face of the accommodating body 81*a*.

An outer circumferential face of the mounting rib 81*c* may be parallel to the outer circumferential face of the accommodating body 81*a*. However, a diameter of the inner circumferential face of the mounting rib 81*c* may be larger than a diameter of the inner circumferential face of the accommodating body 81*a*.

Accordingly, the inner space of the mounting rib 81*c* may be expanded more than the inner space of the accommodating body 81*a*, and the gap C may become wider.

As a result, even when the first sealing member C has a very high viscosity, a sufficient amount thereof may flow into the gap C. Accordingly, a larger amount of the first sealing member C may be injected into the gap C to prevent an opening from being generated between the housing P81 and the window P85. In addition, as the first sealing member C is introduced at a sufficient depth, the foreign substances such as water W or the moisture may not penetrate the first sealing member C.

In one example, the first sealing member C may be embedded to protrude more than an exposed face of the housing P81 or an exposed face of the mounting rib 81*c*. That is, an exposed face of the first sealing member C may protrude more than the mounting rib 81*c*, so that the water W is not able to accumulate on top of the first sealing member C and is able to flow to the outside of the housing 81.

FIG. 18 shows another embodiment of the display portion P8.

In the display portion P8, the shape of the window P85 may be different from that in the above-described embodiment.

Specifically, the window P85 may include a cover body 85*b* disposed on the front face of the display to shield the display, and an extended portion 85*a* protruding from the cover body 85*b* toward the mounting rib and accommodated in the sealant.

In the window P85, the cover body 85*b* may have an outer circumferential face in contact with the first sealing member C, but an exposed face thereof may not be in contact with the first sealing member C. However, in the extended portion 85*a*, not only an outer circumferential face thereof, but also an area corresponding to the exposed face may completely come into contact with the first sealing member C.

In other words, a thickness of the extended portion 85*a* may be smaller than a thickness of the mounting rib 81*c*, so that the extended portion 85*a* may be completely covered when the first sealing member C is embedded to completely fill the space between the mounting rib 81*c* and the cover body 85*b*, thereby blocking the extended portion 85*a* from being exposed to the outside.

Accordingly, the extended portion 85*a* may be completely fixed to the first sealing member C when the first sealing member C is hardened. In this regard, the first sealing member C may apply a pressure up to an internal pressure P to the extended portion 85*a*, thereby further improving the fixed force of the window P85.

Therefore, the window P85 may enlarge an area in contact with the first sealing member C because of the extended portion 85*a*, and may be more firmly fixed to the housing 81 by being in contact with the first sealing member C in both the radial and thickness directions.

In one example, the thickness of the cover body 85*b* may be greater than the thickness of the mounting rib 81*c*. Accordingly, the cover body 85*b* may be blocked from being shielded by the first sealing member C and may properly expose the surface of the display P84.

FIG. 19 shows another embodiment of the display portion P8.

The display portion P8 may have the housing P81 having a shape different from that in the above-described embodiment.

The housing P81 may include the accommodating body 81*a* for fixing the display, and the mounting rib 81*c* disposed on the inner circumferential face of the accommodating body to allow the window to seat thereon and to define the mounting space in which the sealant is accommodated.

The mounting rib 81*c* may include the exposed face spaced apart from the outer circumferential face of the window P85 and exposed to the outside, and an inclined face 81*d* extending from the exposed face toward the window.

The inclined face 81*d* may extend toward the fastening portion 81*b* with an inclination decreasing an inner circumferential face of the mounting rib 81*c*.

Accordingly, when the first sealing member C flows into the gap 81*c*, the first sealing member C may be guided along the inclined face 81*c* to completely fill the gap to an end of the inclined face 81*d* or to the accommodating body 81*a*. In addition, as a volume of the first sealing member C increases from the inclined face 81*d* to the mounting rib 81*c*, the first sealing member C close to the exposed face continues to press the first sealing member C already embedded on the accommodating body 81*a* with an increasing load.

As a result, even when the first sealing member C is made of the material with the very high viscosity, the first sealing member C may be pushed to an inner side of the gap 81*c* and filled and the occurrence of the opening inside the gap 81*c* may be fundamentally blocked.

In one example, the housing P81 may include a seating face 81*e* extending from an inner circumferential face of the inclined face 81*d* to an inner circumferential face of the accommodating body to allow at least a portion of the window P85 to seat thereon. Because of the inclined face 81*d*, a diameter of an outer circumferential face of the seating face 81*e* may be smaller than that of the outer circumferential face of the mounting rib 81*e*.

The seating face 81*e* may form a flat face inside the gap 81*c* to induce a sufficient amount of first sealing member C to be filled up to an inner outer circumferential face of the window P85. Therefore, the outer circumferential face of window P85 may be fixed in contact with a sufficient amount of first sealing member C along the thickness direction from the exposed face to the inside.

In one example, the window P85 may include the cover body 85*b* disposed on the front face of the display 84 to shield the display, and the extended portion 85*a* protruding from the cover body toward the seating face and accommodated in the first sealing member C.

As described above, the extended portion 85*a* may be embedded in the first sealing member C to completely fix the cover body 85*b* to the first sealing member C.

The extended portion 85*a* may be spaced apart from the inclined face 81*d* by a predetermined distance to expose or contact the seating face 81*e* to the first sealing member C. That is, the extended portion 85*a* may be spaced apart from the inclined face 81*d* to maximize an area where the seating face 81*e* is exposed to the first sealing member C.

In one example, the extended portion 85*a* may extend from the cover body 85*b* to the inclined face 81*d* unlike as shown. Accordingly, a lower end or an inner side of the extended portion 85*a* may be fitted to the inclined face 81*d*, so that the cover body 85*b* may be placed at a proper position in the housing P81.

In one example, the extended portion 85*a* may have a thickness smaller than that of the inclined face 81*d*. That is, the thickness of the extended portion 85*a* may be smaller than the thickness of the mounting rib 81*c* and a gap between the exposed face and the seating face 81*e*.

Accordingly, the extended portion 85*a* may be completely accommodated in the first sealing member C, and may be blocked from being exposed to the outside.

The present disclosure may be modified and implemented in various forms, so that the scope of rights thereof is not limited to the above-described embodiment. Therefore, when the modified embodiment includes the components of the claims of the present disclosure, it should be viewed as belonging to the scope of the present disclosure.

The invention claimed is:

1. A laundry treating apparatus comprising:

a cabinet;

a drum rotatably disposed in the cabinet and configured to receive laundry;

a manipulation portion rotatably disposed at the cabinet and configured to receive a selection command for selecting one or more courses to be performed by rotating the drum; and a display portion disposed at the manipulation portion and configured to display a selected course that is selected among the one or more courses via the manipulation portion, wherein the display portion comprises:

a display configured to display the selected course, a housing that is disposed inside the manipulation portion and accommodates the display therein, a window that is disposed at a front of the housing and covers the display, and a sealing configured to block foreign substances from entering a rear side of the window or an inside of the housing.

2. The laundry treating apparatus of claim 1, wherein the display portion further comprises a circuit board accommodated in the housing and configured to control the display portion, and wherein the sealing is configured to covers at least a portion of the housing to thereby reduce or eliminate a chance of the circuit board being exposed to the foreign substances.

3. The laundry treating apparatus of claim 2, further comprising:

a control panel connected to the circuit board;

a casing that is coupled to a rear face of the cabinet and accommodates the control panel therein; and a control line that connects the circuit board and the control panel to each other, wherein the housing comprises:

an accommodating body that accommodates the circuit board and the display therein, wherein the window is disposed at a front side of the accommodating body, and a fastening body that extends from a rear side of the accommodating body and fixes the accommodating body to the casing, wherein the fastening body accommodates the control line therein, and wherein the sealing covers at least one of (i) a space between the accommodating body and the window or (ii) an inside of the fastening body.

4. The laundry treating apparatus of claim 3, wherein the sealing comprises a first sealing that covers a space between an inner circumferential face of the housing and an outer circumferential face of the window.

5. The laundry treating apparatus of claim 4, wherein the housing further comprises a mounting rib that extends from the accommodating body and supports the window, the mounting rib defining a mounting space that accommodates the first sealing, and wherein a diameter of an inner circumferential face of the mounting rib is greater than a diameter of an inner circumferential face of the accommodating body.

6. The laundry treating apparatus of claim 5, wherein the window comprises:

a cover body that is disposed at a front face of the display and covers the display; and an extended portion that protrudes from the cover body toward the mounting rib and is accommodated in the first sealing.

7. The laundry treating apparatus of claim 6, wherein a thickness of the extended portion is less than a thickness of the mounting rib.

8. The laundry treating apparatus of claim 6, wherein a thickness of the cover body is greater than a thickness of the mounting rib.

9. The laundry treating apparatus of claim 5, wherein a diameter of an outer circumferential face of the mounting rib is equal to a diameter of an outer circumferential face of the accommodating body.

10. The laundry treating apparatus of claim 4, wherein the housing comprises a mounting rib that extends from the accommodating body and accommodates at least a portion of the window therein, the mounting rib defining a mounting space that accommodates the first sealing, and wherein the mounting rib comprises:

an exposed face spaced apart from the outer circumferential face of the window and exposed to an outside of the housing, and an inclined face that extends from the exposed face toward the accommodating body and the window.

11. The laundry treating apparatus of claim 10, wherein the accommodating body comprises a seating face that is parallel to the exposed face of the mounting rib and extends from an inner circumferential face of the inclined face of the mounting rib to the window, the seating face supporting at least a portion of the window.

12. The laundry treating apparatus of claim 11, wherein the window comprises:

a cover body disposed at a front face of the display and covers the display; and an extended portion that protrudes from the cover body toward the seating face and is accommodated in the first sealing.

13. The laundry treating apparatus of claim 12, wherein the extended portion is spaced apart from the inclined face and defines a space in which the seating face overlaps with the first sealing.

14. The laundry treating apparatus of claim 12, wherein the extended portion extends from the cover body toward the inner circumferential face of the inclined face.

15. The laundry treating apparatus of claim 14, wherein a thickness of the extended portion is less than a width of the inclined face.

16. The laundry treating apparatus of claim 14, wherein a thickness of the extended portion is less than a gap defined between the exposed face and the seating face.

17. The laundry treating apparatus of claim 1, further comprising a mounting portion that is disposed in the housing and supports the display, wherein a diameter of the window is less than a diameter of the mounting portion.

18. The laundry treating apparatus of claim 4, wherein the sealing further comprises a second sealing that covers at least a portion of the fastening body.

19. The laundry treating apparatus of claim 18, wherein the second sealing is accommodated in the fastening body and is made of an elastic material.

20. The laundry treating apparatus of claim 18, wherein the second sealing comprises a sealing body accommodated in the fastening body, and wherein the sealing body defines:

a sealing body through-hole that extends through the sealing body, wherein the control line passes through the sealing body through-hole, and a cut-out groove defined by cutting a portion of the sealing body, wherein the control line being configured to be inserted into and withdrawn from the sealing body through-hole through the cut-out groove.

21. The laundry treating apparatus of claim 1, further comprising:

a casing fixed to a rear surface of the cabinet; and an encoder disposed at the casing and coupled to the manipulation portion, the encoder being configured to receive the selection command, and wherein the encoder comprises:

a rotating portion coupled to the manipulation portion and configured to rotate relative to the casing, and a fixing portion coupled to the casing and configured to rotatably support the rotating portion.

22. The laundry treating apparatus of claim 21, wherein the housing is coupled to the fixing portion and fixes the display portion to a front face of the cabinet.

* * * * *